US009671119B2

(12) United States Patent
Yamashita et al.

(10) Patent No.: US 9,671,119 B2
(45) Date of Patent: Jun. 6, 2017

(54) AIR-CONDITIONING APPARATUS

(75) Inventors: Koji Yamashita, Tokyo (JP); Hiroyuki Morimoto, Tokyo (JP); Katsuhiro Ishimura, Tokyo (JP); Shinichi Wakamoto, Tokyo (JP); Naofumi Takenaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 411 days.

(21) Appl. No.: 13/885,457

(22) PCT Filed: Jan. 31, 2011

(86) PCT No.: PCT/JP2011/000510

§ 371 (c)(1),
(2), (4) Date: May 15, 2013

(87) PCT Pub. No.: WO2012/104890

PCT Pub. Date: Aug. 9, 2012

(65) Prior Publication Data

US 2013/0233008 A1 Sep. 12, 2013

(51) Int. Cl.
*F25B 29/00* (2006.01)
*F24F 11/00* (2006.01)
(Continued)

(52) U.S. Cl.
CPC ..... *F24F 11/001* (2013.01); *F24F 3/06* (2013.01); *F24F 3/065* (2013.01); *F24F 3/08* (2013.01);
(Continued)

(58) Field of Classification Search
CPC ... F24F 11/001; F24F 3/06; F24F 3/08; F25B 49/02; F25B 41/00; F25B 25/005; F25B 2313/0272; F25B 2700/21152
See application file for complete search history.

(56) References Cited

U.S. PATENT DOCUMENTS 4,326,868 A * 4/1982 Ozu ..... F04C 29/042 417/284
5,711,158 A * 1/1998 Yoshida et al. ..... 62/77
(Continued)

FOREIGN PATENT DOCUMENTS

JP S57198941 A * 12/1982
JP H07198187 A * 8/1995
(Continued)

OTHER PUBLICATIONS

Takashi et al., Refrigeration Cycle System, Dec. 3, 2003, JP2003343936A, Whole Document.*
(Continued)

*Primary Examiner* — Larry Furdge
(74) *Attorney, Agent, or Firm* — Posz Law Group, PLC

(57) ABSTRACT

An air-conditioning apparatus includes a refrigerant circuit including a low-pressure shell structure compressor into which a refrigerant flowing through an injection pipe flows, a first heat exchanger, a second heat exchanger, a first expansion device, a refrigerant flow switching device, and a second expansion device configured to allow the refrigerant which has passed through the first expansion device and flows from the second heat exchanger to the first heat exchanger to have an intermediate pressure, the compressor, the first heat exchanger, the second heat exchanger, the first expansion device, the refrigerant flow switching device, and the second expansion device being connected by pipes to constitute the refrigerant circuit, and further includes a controller that controls an amount of refrigerant flowing through the injection pipe into a compression chamber. A part of a high-pressure refrigerant flowing from the first heat exchanger to the second heat exchanger flows through the injection pipe.

20 Claims, 20 Drawing Sheets

(51) Int. Cl.

| | |
|---|---|
| ***F25B 1/10*** | (2006.01) |
| ***F25B 13/00*** | (2006.01) |
| ***F24F 3/06*** | (2006.01) |
| ***F24F 3/08*** | (2006.01) |
| ***F24F 11/06*** | (2006.01) |
| ***F25B 49/02*** | (2006.01) |
| *F25B 25/00* | (2006.01) |
| *F25B 41/00* | (2006.01) |

(52) U.S. Cl.

CPC ..... *F24F 11/06* (2013.01); *F25B 1/10* (2013.01); *F25B 13/00* (2013.01); *F25B 49/02* (2013.01); *F25B 25/005* (2013.01); *F25B 41/00* (2013.01); *F25B 2313/0231* (2013.01); *F25B 2313/0272* (2013.01); *F25B 2313/02732* (2013.01); *F25B 2313/02741* (2013.01); *F25B 2400/121* (2013.01); *F25B 2500/08* (2013.01); *F25B 2600/25* (2013.01); *F25B 2700/21152* (2013.01)

(56) References Cited

U.S. PATENT DOCUMENTS

| | | | | |
|---|---|---|---|---|
| 6,006,532 | A * | 12/1999 | Suzuki | B60H 1/3225 62/225 |
| 6,405,554 | B1 * | 6/2002 | Kawakatu et al. | 62/335 |
| 7,024,879 | B2 * | 4/2006 | Nakatani | F25B 1/10 62/324.1 |
| 2005/0284164 | A1 * | 12/2005 | Ohta | 62/228.3 |
| 2012/0006050 | A1 | 1/2012 | Takayama et al. | |

FOREIGN PATENT DOCUMENTS

| | | | |
|---|---|---|---|
| JP | H11189035 | A * | 7/1999 |
| JP | H11248295 | A * | 9/1999 |
| JP | 2002-107002 | A | 4/2002 |
| JP | 2003-314930 | A | 11/2003 |
| JP | 2003343936 | A * | 12/2003 |
| JP | 2005-282972 | A | 10/2005 |
| JP | 2007-263443 | A | 10/2007 |
| JP | 2008-138921 | A | 6/2008 |
| JP | 2009-127902 | A | 6/2009 |
| JP | 2009-198099 | A | 9/2009 |
| JP | 2009198087 | A * | 9/2009 |
| JP | 2010-096360 | A | 4/2010 |
| JP | 2010-112579 | A | 5/2010 |
| WO | 2009/154149 | A1 | 12/2009 |
| WO | 2010/049998 | A1 | 5/2010 |
| WO | 2010/113296 | A1 | 10/2010 |

OTHER PUBLICATIONS

Kosaku, Heat Storage Type Air Conditioner, Sep. 14, 1999, JPH11248295A, Whole Document.*

Osamu et al., Air Conditioner, Sep. 3, 2009, JP2009198087A, Whole Document.*

Hiroyuki et al., Heat Pump Type Air Conditioner for Automobile, Jul. 13, 1999, JPH11189035A, Whole Document.*

Hidehiko et al., Air Conditioner, Aug. 1, 1995, JPH07198187A, Whole Document.*

Ikari et al., Air Conditioner, Dec. 6, 1982, JPS57198941A, Whole Document.*

Office Action issued Sep. 17, 2014 in corresponding CN Application No. 201180058104.2 (English Translation).

Office action mailed Mar. 18, 2014 in corresponding JP Application No. 2012-555548 (English Translation).

International Search Report of the International Searching Authority mailed May 10, 2011 for the corresponding international application No. PCT/JP2011/000510 (with English translation).

Extended European Search Report dated Nov. 11, 2016 issued in corresponding EP patent application No. 11857510.9.

* cited by examiner

AIR-CONDITIONING APPARATUS

CROSS REFERENCE TO RELATED APPLICATION

This application is a U.S. national stage application of International Application No. PCT/JP2011/000510 filed on Jan. 31, 2011.

TECHNICAL FIELD

The present invention relates to an air-conditioning apparatus which is applied to, for example, a multi-air-conditioning apparatus for a building.

BACKGROUND ART

Air-conditioning apparatuses, such as a multi-air-conditioning apparatus for a building, include an air-conditioning apparatus configured such that a refrigerant is circulated from an outdoor unit to a relay device (relay unit) and a heat medium, such as water, is circulated from the relay unit to each indoor unit to reduce conveyance power for the heat medium while circulating the heat medium, such as water, through the indoor unit and achieve a cooling and heating mixed operation (see, for example, Patent Literature 1).

A circuit for injecting a liquid refrigerant into a compressor from a high-pressure liquid pipe in a refrigeration cycle in order to reduce a compressor discharge temperature and an air-conditioning apparatus capable of controlling a discharge temperature at a preset temperature, irrespective of an operation state, have been recently developed (see, for example, Patent Literature 2).

Another air-conditioning apparatus which uses, as a refrigerant, R32 that is a refrigerant having a relatively low global warming potential (GWP) and performs injection (refrigerant supply) from an outlet side of a gas-liquid separator in a high-pressure liquid pipe of a refrigeration cycle into a compressor (high-pressure shell compressor) in which the inside of a sealed container is at a discharge pressure atmosphere has been recently developed (see, for example, Patent Literature 3).

CITATION LIST

Patent Literature

Patent Literature 1: International Publication No. WO10/049,998 (Page 3, FIG. 1 for example)

Patent Literature 2: Japanese Unexamined Patent Application Publication No. 2005-282972 (Page 4, FIG. 1, for example)

Patent Literature 3: Japanese Unexamined Patent Application Publication No. 2009-127902 (Page 4, FIG. 1, for example)

SUMMARY OF INVENTION

Technical Problem

In an air-conditioning apparatus, such as a multi-air-conditioning apparatus for a building, disclosed in Patent Literature 1, for example, if R410A is used as a refrigerant, no problems will arise. However, if, for example, R32 is used as a refrigerant, a compressor discharge temperature may become too high during, for example, heating at a low outside air temperature. Disadvantageously, the refrigerant or a refrigerating machine oil may deteriorate thereby. Although the cooling and heating mixed operation is described in Patent Literature 1, no method of reducing a discharge temperature is mentioned therein. In a multi-air-conditioning apparatus for a building, an expansion device, such as an electronic expansion valve, for reducing the pressure of a refrigerant is disposed in a relay unit or an indoor unit which is separated from an outdoor unit.

As regards the air-conditioning apparatus disclosed in Patent Literature 2, only the method of injection from the high-pressure liquid pipe is described. Disadvantageously, the injection may fail to be supported upon, for example, reverse of a circulation passage in the refrigeration cycle (switching between cooling and heating). Accordingly, the injection is not supported in the cooling and heating mixed operation.

As regards the air-conditioning apparatus disclosed in Patent Literature 3, a method of injecting the refrigerant from the high-pressure liquid pipe using a plurality of check valves not only in cooling operation but also in heating operation is disclosed. Disadvantageously, the method cannot be applied only to a case where an expansion device, such as an electronic expansion valve, is disposed not in an indoor unit but in an outdoor unit. The compressor used in Patent Literature 3 has a high-pressure shell structure. Additionally, this injection is not supported in the cooling and heating mixed operation.

The present invention has been made to overcome the above-described disadvantages and provides an air-conditioning apparatus that is a system in which an expansion device, such as an electronic expansion valve, for reducing the pressure of a refrigerant is disposed in a relay unit or indoor unit apart from an outdoor unit and a low-pressure or intermediate-pressure refrigerant in a two-phase (gas-liquid two-phase) state or a liquid state is returned from the relay unit or indoor unit to the outdoor unit in, for example, a heating operation and which includes a compressor having a low-pressure shell structure, the air-conditioning apparatus including a refrigerant circuit capable of reliably controlling a discharge temperature such that the discharge temperature does not become too high and preventing the refrigerant and a refrigerating machine oil from deteriorating.

Solution to Problem

The present invention provides an air-conditioning apparatus including a refrigerant circuit that includes a low-pressure shell structure compressor which includes a compression chamber having an opening into which a refrigerant flowing through an injection pipe flows and a sealed container accommodating the compression chamber, the compressor allowing the sealed container to have a low-pressure refrigerant atmosphere therein and allowing the low-pressure refrigerant in the sealed container to flow into the compression chamber in order to compress the refrigerant, a first heat exchanger and at least one second heat exchanger which are configured to evaporate or condense the refrigerant, at least one first expansion device which reduces a pressure of the refrigerant, a refrigerant flow switching device which switches between a passage allowing a high-pressure refrigerant to pass through the first heat exchanger such that the first heat exchanger is allowed to function as a condenser and a passage allowing a low-pressure refrigerant to pass through the first heat exchanger such that the first heat exchanger is allowed to function as an evaporator, and a second expansion device configured to allow the refrigerant which has passed through the first expansion device and flows from the second heat exchanger to the first heat exchanger to have an intermediate pressure which is lower than the high pressure and is higher than the low pressure, the compressor, the first heat exchanger, the second heat exchanger, the first expansion device, the refrigerant flow switching device, and the second expansion device being connected by pipes to constitute the refrigerant circuit. The apparatus further includes a controller which controls an amount of the refrigerant flowing through the injection pipe into the compression chamber. While the first heat exchanger functions as a condenser, a part of the high-pressure refrigerant flowing from the first heat exchanger to the second heat exchanger is enabled to flow through the injection pipe. While the first heat exchanger functions as an evaporator, a part of the refrigerant allowed to have the intermediate pressure by the second expansion device is enabled to flow through the injection pipe. A discharge temperature of the compressor is controlled so as not to become too high in any of cooling and heating operations, even in the use of a refrigerant, such as R32, which may cause a high temperature. The refrigerant and a refrigerating machine oil are therefore prevented from deteriorating, thus achieving a safe operation.

ADVANTAGEOUS EFFECTS OF INVENTION

In the use of a refrigerant, such as R32, which may cause a high compressor discharge temperature, the air-conditioning apparatus according to the present invention can inject the refrigerant into the compression chamber of the compressor, irrespective of the operation in which the first heat exchanger serves as a condenser and the operation in which the first heat exchanger serves as an evaporator. Advantageously, the air-conditioning apparatus capable of controlling the discharge temperature such that the discharge temperature does not become too high, preventing the refrigerant and the refrigerating machine oil from deteriorating, and achieving a safe operation can be provided.

DESCRIPTION OF EMBODIMENTS

Embodiment 1

Embodiment 1 of the present invention will be described with reference to the drawings.

Figure 1:
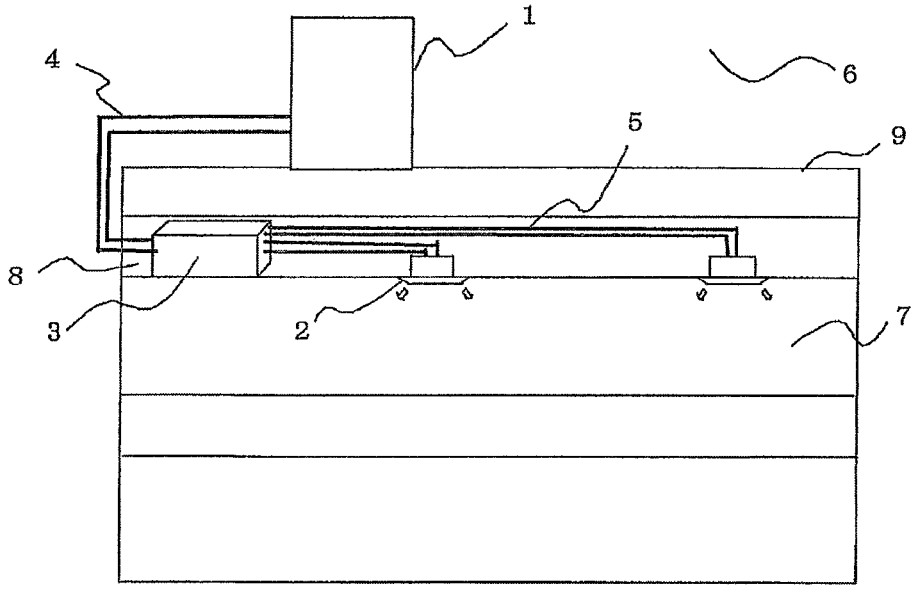
FIG. 1 is a schematic diagram illustrating an example of installation of an air-conditioning apparatus according to Embodiment 1 of the present invention.

FIG. 1 is a schematic diagram illustrating an example of installation of an air-conditioning apparatus according to Embodiment 1 of the present invention. The example of installation of the air-conditioning apparatus will be described with reference to FIG. 1. This air-conditioning apparatus uses a refrigeration cycle (a refrigerant circuit A and a heat medium circuit B), in which a heat source side refrigerant and a heat medium are circulated, to permit each indoor unit 2 to freely select a cooling mode or a heating mode as an operation mode. Note that the dimensional relationships among components in FIG. 1 and the following figures may be different from the actual ones. As regards temperature levels and pressure levels in the following description, the levels are not determined in relation to particular absolute values but are indicated on the basis of their relation determined relatively in a state or operation of the apparatus, for example.

In FIG. 1, the air-conditioning apparatus according to Embodiment 1 includes a single outdoor unit 1, serving as an outdoor unit (heat source unit), a plurality of indoor units 2, and a heat medium relay unit 3, serving as a relay unit (relay unit), disposed between the outdoor unit 1 and the indoor units 2. The heat medium relay unit 3 is configured to exchange heat between the heat source side refrigerant and the heat medium. The outdoor unit 1 is connected to the heat medium relay unit 3 by refrigerant pipes 4 through which the heat source side refrigerant is conveyed. The heat medium relay unit 3 is connected to each indoor unit 2 by pipes (heat medium pipes) 5 through which the heat medium is conveyed. Cooling energy or heating energy produced in the outdoor unit 1 is delivered through the heat medium relay unit 3 to the indoor units 2.

The outdoor unit 1, typically disposed in an outdoor space 6 which is a space (e.g., a roof) outside a structure 9, such as a building, is configured to supply cooling energy or heating energy through the heat medium relay unit 3 to the indoor units 2. Each indoor unit 2 is disposed at a position such that it can supply cooling air or heating air to an indoor space 7 which is a space (e.g., a living room) inside the structure 9 and is configured to supply the cooling air or heating air to the indoor space 7, serving as an air-conditioning target space. The heat medium relay unit 3 is configured so as to include a housing separated from housings of the outdoor unit 1 and the indoor units 2 such that the heat medium relay unit 3 can be disposed at a different position from those of the outdoor space 6 and the indoor space 7. The heat medium relay unit 3 is connected to the outdoor unit 1 through the refrigerant pipes 4 and is connected to the indoor units 2 through the pipes 5 to transfer cooling energy or heating energy, supplied from the outdoor unit 1, to the indoor units 2.

In the air-conditioning apparatus illustrated in FIG. 1 and the other figures, the outdoor unit 1 is connected to the heat medium relay unit 3 using two refrigerant pipes 4 and the heat medium relay unit 3 is connected to each indoor unit 2 using two pipes 5. As described above, in the air-conditioning apparatus according to Embodiment 1, each of the units (the outdoor unit 1, the indoor units 2, and the heat medium relay unit 3) is connected using two pipes (the refrigerant pipes 4 or the pipes 5), thus facilitating construction.

FIG. 1 illustrates a state where the heat medium relay unit 3 is disposed in a different space from the indoor space 7, for example, a space above a ceiling (hereinafter, simply referred to as a "space 8") inside the structure 9. The heat medium relay unit 3 can be placed in another space, for example, a common space including an elevator. Furthermore, although FIG. 1 illustrates a case where the indoor units 2 are of a ceiling cassette type, the indoor units are not limited to this type and may be of any type, such as a ceiling concealed type or a ceiling suspended type, capable of blowing out heating air or cooling air into the indoor space 7 directly or through a duct, for example.

Although FIG. 1 illustrates the case where the outdoor unit 1 is placed in the outdoor space 6, the placement is not limited to this case. For example, the outdoor unit 1 may be placed in an enclosed space, for example, a machine room with a ventilation opening. The outdoor unit 1 may be disposed inside the structure 9 as long as waste heat can be exhausted through an exhaust duct to the outside of the structure 9. Alternatively, the indoor unit 1 of a water-cooled type may be used and be disposed inside the structure 9. Even when the outdoor unit 1 is disposed in any place, no problem in particular will occur.

Furthermore, the heat medium relay unit 3 can be disposed near the outdoor unit 1. If the distance between the heat medium relay unit 3 and each indoor unit 2 is too long, the conveyance power for the heat medium would be considerably large. It should therefore be noted that the effect of energy saving is reduced in this case. In addition, the number of outdoor units 1, the number of indoor units 2, and the number of heat medium relay units 3 which are connected are not limited to the numbers illustrated in, for example, FIG. 1. The numbers may be determined depending on the structure 9 where the air-conditioning apparatus according to Embodiment 1 is installed.

Figure 2:
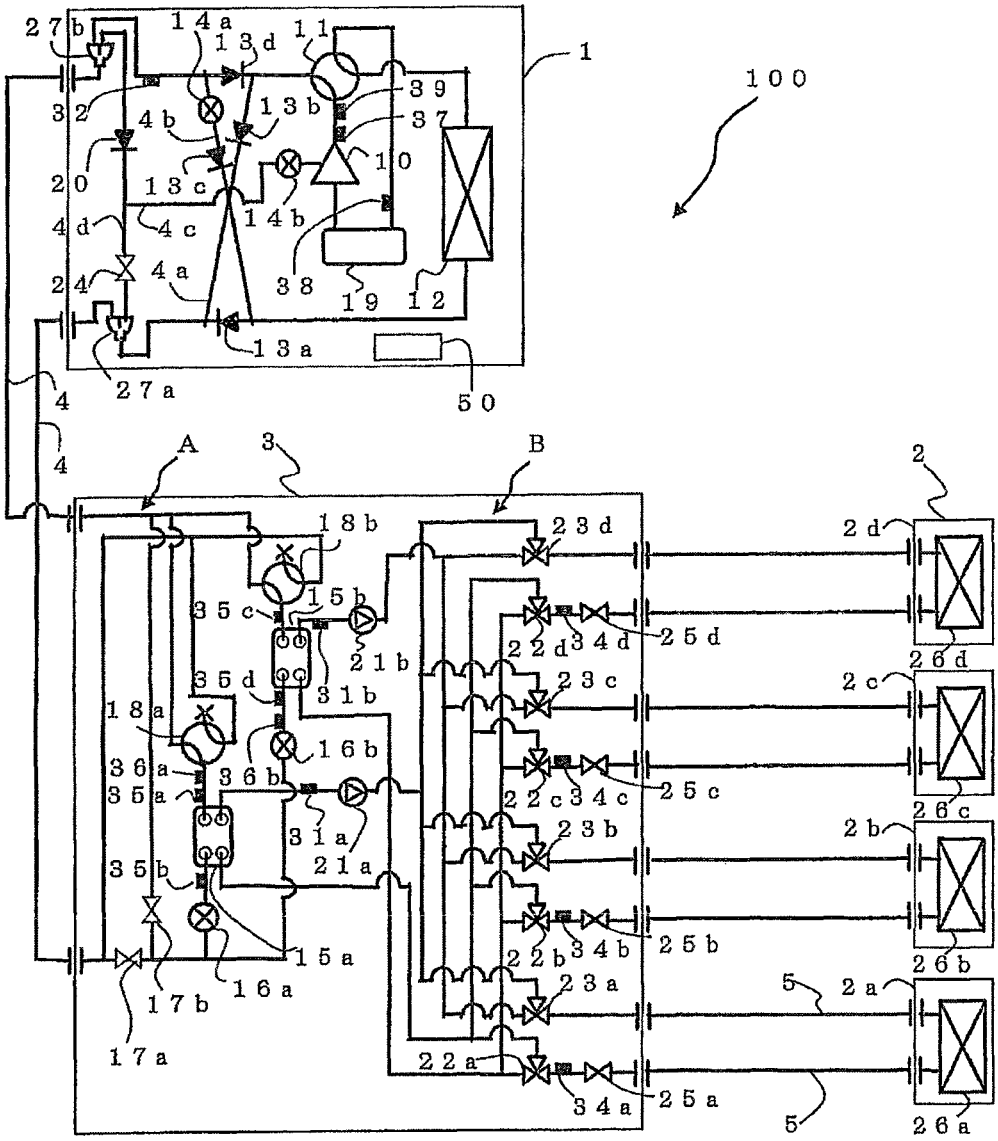
FIG. 2 is a diagram illustrating a circuit configuration of an air-conditioning apparatus according to Embodiment 1 of the present invention.

FIG. 2 is a schematic diagram illustrating an exemplary circuit configuration of the air-conditioning apparatus (hereinafter, referred to as the "air-conditioning apparatus 100") according to Embodiment 1. The detailed configuration of the air-conditioning apparatus 100 will be described with reference to FIG. 2. Referring to FIG. 2, the outdoor unit 1 and the heat medium relay unit 3 are connected by the refrigerant pipes 4 through a heat exchanger related to heat medium 15*a* and a heat exchanger related to heat medium 15*b*, which serve as second heat exchangers, arranged in the heat medium relay unit 3. Furthermore, the heat medium relay unit 3 and each indoor unit 2 are also connected by the pipes 5 through the heat exchanger related to heat medium 15*a* and the heat exchanger related to heat medium 15*b*. The refrigerant pipes 4 will be described in detail later.

[Outdoor Unit 1]

The outdoor unit 1 includes a compressor 10, a first refrigerant flow switching device 11, such as a four-way valve, a heat source side heat exchanger 12, serving as a first heat exchanger, and an accumulator 19 which are connected in series by the refrigerant pipes 4. The outdoor unit 1 further includes a first connecting pipe 4*a*, a second connecting pipe 4*b*, a check valve 13*a*, a check valve 13*b*, a check valve 13*c*, and a check valve 13*d*. Such an arrangement of the first connecting pipe 4*a*, the second connecting pipe 4*b*, the check valve 13*a*, the check valve 13*b*, the check valve 13*c*, and the check valve 13*d* enables the heat source side refrigerant, flowing to and from the heat medium relay unit 3, to flow in a constant direction irrespective of an operation requested by any indoor unit 2.

The compressor 10 is configured to suck the heat source side refrigerant and compress the heat source side refrigerant to a high-temperature high-pressure state, and may be a capacity-controllable inverter compressor, for example. The structure of the compressor 10 and related matters will be described later.

The first refrigerant flow switching device 11 is configured to switch between a direction of flow of the heat source side refrigerant in a heating operation (including a heating only operation mode and a heating main operation mode) and a direction of flow of the heat source side refrigerant in a cooling operation (including a cooling only operation mode and a cooling main operation mode). The heat source side heat exchanger 12 is configured to function as an evaporator in the heating operation and function as a condenser (or a radiator) in the cooling operation to exchange heat between air supplied from a fan (not illustrated) and the heat source side refrigerant such that the heat source side refrigerant evaporates and gasifies or condenses and liquefies. The accumulator 19 is disposed on a heat-source-side-refrigerant suction side of the compressor 10 and is configured to store an excess amount of the heat source side refrigerant.

The check valve 13*d* is disposed in the refrigerant pipe 4 positioned between the heat medium relay unit 3 and the first refrigerant flow switching device 11 and is configured to permit the heat source side refrigerant to flow only in a predetermined direction (the direction from the heat medium relay unit 3 to the outdoor unit 1). The check valve 13*a* is disposed in the refrigerant pipe 4 positioned between the heat source side heat exchanger 12 and the heat medium relay unit 3 and is configured to permit the heat source side refrigerant to flow only in a predetermined direction (the direction from the outdoor unit 1 to the heat medium relay unit 3). The check valve 13*b* is disposed in the first connecting pipe 4*a* and is configured to allow the heat source side refrigerant, discharged from the compressor 10 in the heating operation, to flow to the heat medium relay unit 3. The check valve 13*c* is disposed in the second connecting pipe 4*b* and is configured to allow the heat source side refrigerant, returned from the heat medium relay unit 3 in the heating operation, to flow to the suction side of the compressor 10.

The first connecting pipe 4*a* is configured to connect the refrigerant pipe 4, positioned between the first refrigerant flow switching device 11 and the check valve 13*d*, to the refrigerant pipe 4, positioned between the check valve 13*a* and the heat medium relay unit 3, in the outdoor unit 1. The second connecting pipe 4*b* is configured to connect the refrigerant pipe 4, positioned between the check valve 13*d* and the heat medium relay unit 3, to the refrigerant pipe 4, positioned between the heat source side heat exchanger 12 and the check valve 13*a*, in the outdoor unit 1.

In a refrigeration cycle apparatus, a rise in temperature of a heat source side refrigerant causes the heat source side refrigerant circulating in a refrigerant circuit A and a refrigerating machine oil to deteriorate. Accordingly, an upper limit temperature is set. In the refrigerant circuit A, the upper limit temperature is typically set to 120° C. Since the highest temperature of the heat source side refrigerant in the refrigeration cycle A is a temperature (discharge temperature) on a discharge side of the compressor 10, control is performed such that the discharge temperature does not exceed 120° C. as much as possible. For example, in the use of R410A as the heat source side refrigerant, the discharge temperature rarely reaches 120° C. in a normal operation. In the use of R32 as the heat source side refrigerant, however, the discharge temperature is high due to the physical properties of the refrigerant. Accordingly, there is high possibility that the discharge temperature may reach or exceed 120° C., as will be described later. It is therefore necessary to take measures using means or a mechanism for reducing the discharge temperature.

According to Embodiment 1, the outdoor unit 1 includes a branching portion 27*a* which serves as first branching means, a branching portion 27*b* which serves as second branching means, the branching portions each including a divider or a distributor, an injection opening and closing device 24, a backflow prevention device 20, an expansion device 14*a* which serves as a second expansion device, an expansion device 14*b* which serves as a third expansion device, an injection pipe 4*c*, and a branch pipe 4*d*. These devices and pipes constitute an injection circuit in the refrigerant circuit A. The outdoor unit 1 further includes an intermediate-pressure detection device 32, a refrigerant discharge temperature detection device 37, a refrigerant suction temperature detection device 38, and a high-pressure detection device 39. The outdoor unit 1 further includes a controller 50 for refrigerant temperature control, for example.

Furthermore, the compressor 10 has a low-pressure shell structure in which a compression chamber is provided in a sealed container, the sealed container has a low-pressure refrigerant atmosphere therein, and a low-pressure refrigerant in the sealed container is sucked into the compression chamber in order to compress the refrigerant. The compression chamber of the compressor 10 has an opening in part thereof. The compressor 10 is provided with the injection pipe 4*c* for supplying the heat source side refrigerant from the outside of the sealed container through the opening into the compression chamber. The supply of the heat source side refrigerant from the injection pipe 4*c* through the opening into the compression chamber can reduce the temperature of the heat source side refrigerant discharged from the compressor 10 or the degree of superheat (discharge superheat) of the heat source side refrigerant discharged from the compressor 10.

The controller 50 controls, for example, the injection opening and closing device 24, the expansion device 14*a*, and the expansion device 14*b* to control the supply of the heat source side refrigerant from the injection pipe 4*c*, thereby reducing the discharge temperature of the compressor 10. Consequently, a safe operation can be achieved. A specific control operation will be described later for each operation mode, which will be described later. The controller 50 includes a microcomputer or the like and controls the devices on the basis of information items detected by various detection devices and an instruction from a remote control. In addition to controlling of the above-described actuators, the controller 50 controls, for example, a driving frequency of the compressor 10, a rotation speed (including ON/OFF) of each fan, and switching by the first refrigerant flow switching device 11 to perform any of the operation modes which will be described later.

The difference in discharge temperature between the use of R410A, as the heat source side refrigerant, and the use of R32 will be described below. For example, it is assumed that an evaporating temperature in the refrigeration cycle is 0° C., a condensing temperature is 49° C., and a superheat (degree of superheat) of a compressor suction refrigerant is 0° C. Assuming that R410A is used as the heat source side refrigerant and adiabatic compression (isentropic compression) is performed, the discharge temperature of the compressor 10 is approximately 70° C. due to the physical properties of the refrigerant. Furthermore, assuming that R32 is used as the heat source side refrigerant and adiabatic compression (isentropic compression) is performed, the discharge temperature of the compressor 10 is approximately 86° C. due to the physical properties of the refrigerant. Accordingly, the discharge temperature in the use of R32 as the heat source side refrigerant is approximately 16° C. higher than that in the use of R410A. In an actual operation, polytropic compression is performed in the compressor 10, thus resulting in a less efficient operation than that in adiabatic compression. The discharge temperature is therefore higher than the above-described value. For example, in the use of A410A, an operation in a state where the discharge temperature exceeds 100° C. may often occur. The discharge temperature in the use of R32 exceeds the limit of 120° C. on condition that an operation is performed in such a manner that the discharge temperature in the use of R410A exceeds 104° C. It is therefore necessary to reduce the discharge temperature.

For example, in a compressor having a high-pressure shell structure in which a sucked refrigerant is directly sucked into a compression chamber and a heat source side refrigerant discharged from the compression chamber is discharged into a sealed container surrounding the compression chamber, the heat source side refrigerant in a two-phase state in which the refrigerant contains more moisture than in a saturated state is sucked into the compression chamber. Thus, the discharge temperature can be reduced.

In the use of a low-pressure shell structure compressor like the compressor 10, however, if the refrigerant to be sucked is moisturized, a liquid refrigerant will remain in the shell of the compressor 10. A two-phase refrigerant will not be sucked into the compression chamber. To reduce the discharge temperature in the case where the compressor 10 having the low-pressure shell structure is used and R32 that may cause a high discharge temperature is used, therefore, a low-temperature heat source side refrigerant is injected from the outside into the compression chamber in compression such that the temperature of the heat source side refrigerant is reduced. In this case, the supply of the refrigerant from the injection pipe 4*c* reduces the discharge temperature.

As regards the injection into the compression chamber of the compressor 10 under the control of the controller 50, the discharge temperature is controlled to a target value (e.g., 100° C.). A control target value may be changed depending on outdoor air temperature. Furthermore, control may be performed such that injection is performed before the discharge temperature exceeds a predetermined value (e.g., 110° C.) and injection is not performed while the discharge temperature is at or below the predetermined value. Additionally, the discharge temperature may be controlled within a target range (for example, from 80° C. to 100° C.) such that when the discharge temperature almost exceeds an upper limit of the target range, the amount of injection is increased, and when the discharge temperature is almost below a lower limit of the target range, the amount of injection is reduced. Furthermore, a discharge superheat (degree of discharge superheat) is calculated on the basis of a high-pressure side pressure detected by the high-pressure detection device 39 and a discharge temperature detected by the refrigerant discharge temperature detection device 37. The amount of injection may be controlled such that the discharge superheat reaches a target value (e.g., 30° C.) and a control target value may be changed depending on outdoor air temperature.

Furthermore, control may be performed such that injection is performed before the discharge superheat exceeds a predetermined value (e.g., 40° C.) and injection is not performed while the discharge superheat is at or below the predetermined value. Additionally, the discharge superheat may be controlled to be within a target range (for example, from 10° C. to 40° C.) such that when the discharge superheat almost exceeds an upper limit of the target range, the amount of injection is increased, and when the discharge superheat is almost below a lower limit of the target range, the amount of injection is reduced.

Although the case where the heat source side refrigerant circulating in the refrigerant circuit A is R32 has been described above, the configuration according to Embodiment 1 can reduce a discharge temperature in the use of any refrigerant that may cause higher discharge temperature than conventional R410A on conditions that the condensing temperature, the evaporating temperature, the superheat (degree of superheat), the subcooling (degree of subcooling), and the compressor efficiency are the same as those in the use of conventional A410A, and the same advantages are achieved. Particularly, greater advantages are achieved in the use of a heat source side refrigerant that may cause at least 3° C. higher discharge temperature than R410A.

Figure 3:
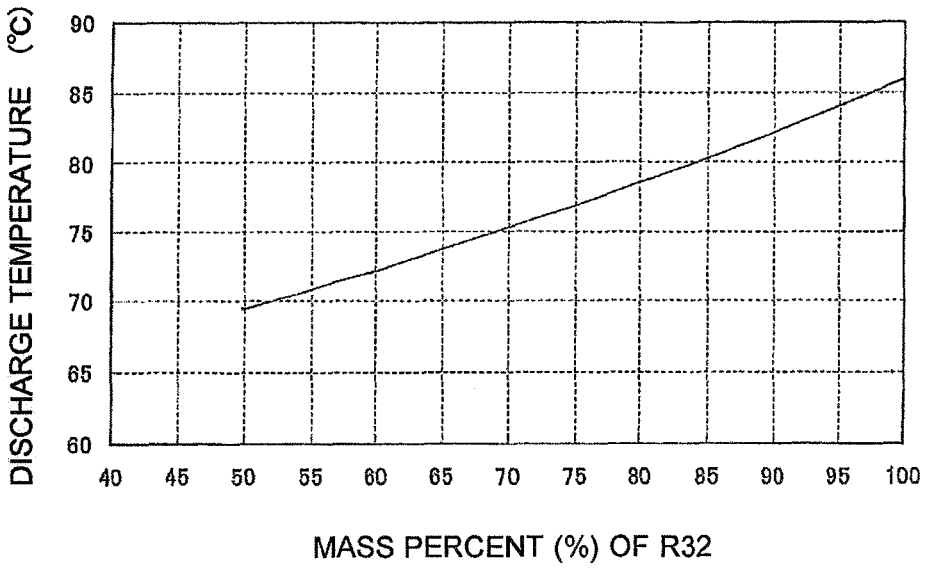
FIG. 3 is a diagram illustrating the relation between the mass percent of R32 and a discharge temperature in the use of a refrigerant mixture in the air-conditioning apparatus according to Embodiment 1 of the present invention.

FIG. 3 is a graph illustrating a change in discharge temperature plotted against the mass percent of R32 in a refrigerant mixture of R32 and HFO1234yf. HFO1234yf is a tetrafluoropropene refrigerant that has a low global warming potential and is expressed by the chemical formula $CF_3CF{=}CH_2$. The discharge temperature is estimated on the assumption that adiabatic compression (isentropic compression) has been performed in a manner similar to the above description.

FIG. 3 demonstrates that when the mass percent of R32 is 52%, the discharge temperature is approximately 70° C. which is substantially the same as the discharge temperature in the use of R410A, and when the mass percent of R32 is 62%, the discharge temperature is approximately 73° C. which is 3° C. higher than that in the use of R410A. Accordingly, great advantages are achieved in the case where the discharge temperature is reduced by injection in the use of a refrigerant mixture of R32 and HFO1234yf in which the mass percent of R32 is greater than or equal to 62%.

Furthermore, discharge temperatures in the use of refrigerant mixtures of R32 and HFO1234ze, which is a tetrafluoropropene refrigerant that has a low global warming potential and is expressed by the chemical formula $CF_3CH{=}CHF$, are calculated in a manner similar to the above description. This calculation proves that when the mass percent of R32 is 34%, the discharge temperature is approximately 70° C. which is substantially the same as the discharge temperature in the use of R410A, and when the mass percent of R32 is 43%, the discharge temperature is approximately 73° C. which is 3° C. higher than that in the use of R410A. Accordingly, great advantages are achieved in the case where the discharge temperature is reduced by injection in the use of such a refrigerant mixture in which the mass percent of R32 is greater than or equal to 43%.

The above estimations and calculations have been made using REFPROP Version 8.0 marketed by NIST (National Institute of Standards and Technology). Furthermore, the number of kinds of refrigerant in a refrigerant mixture is not limited to two. If a refrigerant mixture includes three or more refrigerants containing a small amount of another refrigerant, a discharge temperature will not be considerably affected by the number of kinds of refrigerant. Accordingly, the same advantages are achieved. For example, a refrigerant mixture of R32, HFO1234yf, and a small amount of another refrigerant may be used. As described above, the calculations have been made on the assumption of adiabatic compression. Since actual compression is polytropic compression, a temperature may be several tens of degrees or greater, for example, at least 20° C. higher than the above-described temperature.

[Indoor Units 2]

The indoor units 2 each include a use side heat exchanger 26. This use side heat exchanger 26 is connected by the pipes 5 to a heat medium flow control device 25 and a second heat medium flow switching device 23 arranged in the heat medium relay unit 3. This use side heat exchanger 26 is configured to exchange heat between air supplied from a fan (not illustrated) and the heat medium in order to produce heating air or cooling air to be supplied to the indoor space 7.

FIG. 2 illustrates a case where four indoor units 2 are connected to the heat medium relay unit 3. An indoor unit 2*a*, an indoor unit 2*b*, an indoor unit 2*c*, and an indoor unit 2*d* are illustrated in that order from the bottom of the drawing sheet. In addition, the use side heat exchangers 26 are illustrated as a use side heat exchanger 26*a*, a use side heat exchanger 26*b*, a use side heat exchanger 26*c*, and a use side heat exchanger 26*d* in that order from the bottom of the drawing sheet so as to correspond to the indoor units 2*a* to 2*d*, respectively. Note that the number of indoor units 2 connected is not limited to four as illustrated in FIG. 2, as in the case of FIG. 1.

[Heat Medium Relay Unit 3]

The heat medium relay unit 3 includes the two heat exchangers related to heat medium 15, two expansion devices 16, two opening and closing devices 17, and two second refrigerant flow switching devices 18. The heat medium relay unit 3 further includes two pumps 21, four first heat medium flow switching devices 22, the four second heat medium flow switching devices 23, and the four heat medium flow control devices 25.

Each of the two heat exchangers related to heat medium 15 (the heat exchanger related to heat medium 15*a* and the heat exchanger related to heat medium 15*b*), serving as second heat exchangers, functions as a condenser (radiator) or an evaporator in the refrigerant circuit A. Each heat exchanger related to heat medium 15 is configured to exchange heat between the heat source side refrigerant and the heat medium such that the heat source side refrigerant transfers cooling energy or heating energy, produced by the outdoor unit 1 and stored in the heat source side refrigerant, to the heat medium. The heat exchanger related to heat medium 15*a* is disposed between an expansion device 16*a* and a second refrigerant flow switching device 18*a* in the refrigerant circuit A and is used to cool the heat medium in a cooling and heating mixed operation mode, which will be described later. Furthermore, the heat exchanger related to heat medium 15*b* is disposed between an expansion device 16*b* and a second refrigerant flow switching device 18*b* in the refrigerant circuit A and is used to heat the heat medium in the cooling and heating mixed operation mode, which will be described later.

The two expansion devices 16 (the expansion device 16*a* and the expansion device 16*b*), serving as first expansion devices, each have functions of a pressure reducing valve and an expansion valve and are configured to reduce the pressure of the heat source side refrigerant in order to expand it. The expansion device 16*a* is disposed upstream of the heat exchanger related to heat medium 15*a* in the flow direction of the heat source side refrigerant in the cooling operation. The expansion device 16*b* is disposed upstream of the heat exchanger related to heat medium 15*b* in the flow direction of the heat source side refrigerant in the cooling operation. Each of the two expansion devices 16 may be a component having a variably controllable opening degree (opening area), for example, an electronic expansion valve.

The two opening and closing devices 17 (an opening and closing device 17*a* and an opening and closing device 17*b*) each include a two-way valve and are configured to open or close the refrigerant pipe 4. The opening and closing device 17*a* is disposed in the refrigerant pipe 4 on an inlet side for the heat source side refrigerant. The opening and closing device 17*b* is disposed in a pipe connecting the refrigerant pipe 4 on the inlet side for the heat source side refrigerant and the refrigerant pipe 4 on an outlet side therefor. The two second refrigerant flow switching devices 18 (the second refrigerant flow switching device 18*a* and the second refrigerant flow switching device 18*b*) each include a four-way valve and are configured to switch between flow directions of the heat source side refrigerant in accordance with an operation mode. The second refrigerant flow switching device 18*a* is disposed in the downstream of the heat exchanger related to heat medium 15*a* in the flow direction of the heat source side refrigerant in the cooling operation. The second refrigerant flow switching device 18*b* is disposed in the downstream of the heat exchanger related to heat medium 15*b* in the flow direction of the heat source side refrigerant in the cooling only operation.

The two pumps 21 (a pump 21*a* and a pump 21*b*) are configured to circulate the heat medium conveyed through the pipes 5. The pump 21*a* is disposed in the pipe 5 positioned between the heat exchanger related to heat medium 15*a* and the second heat medium flow switching devices 23. The pump 21*b* is disposed in the pipe 5 positioned between the heat exchanger related to heat medium 15*b* and the second heat medium flow switching devices 23. Each of the two pumps 21 may be, for example, a capacity-controllable pump.

The four first heat medium flow switching devices 22 (first heat medium flow switching devices 22*a* to 22*d*) each include a three-way valve and are configured to switch between passages for the heat medium. The first heat medium flow switching devices 22 whose number (four in this case) corresponds to the number of indoor units 2 installed are arranged. Each first heat medium flow switching device 22 is disposed on an outlet side of a heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the heat medium flow control device 25. Note that the first heat medium flow switching device 22*a*, the first heat medium flow switching device 22*b*, the first heat medium flow switching device 22*c*, and the first heat medium flow switching device 22*d* are illustrated in that order from the bottom of the drawing sheet of FIG. 2 so as to correspond to the indoor units 2 (the same shall apply to the following figures).

The four second heat medium flow switching devices 23 (second heat medium flow switching devices 23*a* to 23*d*) each include a three-way valve and are configured to switch between passages for the heat medium. The second heat medium flow switching devices 23 whose number (four in this case) corresponds to the number of indoor units 2 installed are arranged. Each second heat medium flow switching device 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the use side heat exchanger 26. Note that the second heat medium flow switching device 23*a*, the second heat medium flow switching device 23*b*, the second heat medium flow switching device 23*c*, and the second heat medium flow switching device 23*d* are illustrated in that order from the bottom of the drawing sheet of FIG. 2 so as to correspond to the indoor units 2 (the same shall apply to the following figures).

The four heat medium flow control devices 25 (heat medium flow control devices 25*a* to 25*d*) each include a two-way valve capable of controlling the opening area and are configured to control the rate of flow through the pipe 5. The heat medium flow control devices 25 whose number (four in this case) corresponds to the number of indoor units 2 installed are arranged. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Note that the heat medium flow control device 25*a*, the heat medium flow control device 25*b*, the heat medium flow control device 25*c*, and the heat medium flow control device 25*d* are illustrated in that order from the bottom of the drawing sheet of FIG. 2, for example, so as to correspond to the indoor units 2 (the same shall apply to the following figures). Furthermore, each heat medium flow control device 25 may be disposed on the inlet side of the heat medium passage of the corresponding use side heat exchanger 26.

The heat medium relay unit 3 further includes two heat-exchanger-related-to-heat-medium outlet temperature detection devices 31 (hereinafter, referred to as "first temperature sensors 31"), four use-side-heat-exchanger outlet temperature detection devices 34 (hereinafter, referred to as "second temperature sensors 34"), four heat-exchanger-related-to-heat-medium refrigerant temperature detection devices 35 (hereinafter, referred to as "third temperature sensors 35"), and two heat-exchanger-related-to-heat-medium refrigerant pressure detection devices 36 (hereinafter, referred to as "pressure sensors 36"). Information items (temperature information items and pressure information items) detected by these detection devices are transmitted to the above-described controller 50 and are used to control, for example, the driving frequency of the compressor 10, the rotation speed of each fan (not illustrated), switching by the first refrigerant flow switching device 11, a driving frequency of the pumps 21, switching by the second refrigerant flow switching devices 18, and switching between passages for the heat medium.

Each of the two first temperature sensors 31 (a first temperature sensor 31*a* and a first temperature sensor 31*b*) is configured to detect a temperature of the heat medium flowing from the heat exchanger related to heat medium 15, namely, the heat medium on the outlet side of the heat exchanger related to heat medium 15, and may be a thermistor, for example. The first temperature sensor 31*a* is disposed in the pipe 5 on an inlet side of the pump 21*a*. The first temperature sensor 31*b* is disposed in the pipe 5 on an inlet side of the pump 21*b*.

Each of the four second temperature sensors 34 (second temperature sensors 34*a* to 34*d*) is disposed between the first heat medium flow switching device 22 and the heat medium flow control device 25 and is configured to detect a temperature of the heat medium flowing from the use side heat exchanger 26 and may be a thermistor, for example. The second temperature sensors 34 whose number (four in this case) corresponds to the number of indoor units 2 installed are arranged. Note that the second temperature sensor 34*a*, the second temperature sensor 34*b*, the second temperature sensor 34*c*, and the second temperature sensor 34*d* are illustrated in this order from the bottom of the drawing sheet so as to correspond to the indoor units 2.

Each of the four third temperature sensors 35 (third temperature sensors 35*a* to 35*d*) is disposed on a heat-source-side-refrigerant inlet or outlet side of the heat exchanger related to heat medium 15 and is configured to detect a temperature of the heat source side refrigerant flowing into the heat exchanger related to heat medium 15 or a temperature of the heat source side refrigerant flowing from the heat exchanger related to heat medium 15 and may be a thermistor, for example. The third temperature sensor 35*a* is disposed between the heat exchanger related to heat medium 15*a* and the second refrigerant flow switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18*b*. The third temperature sensor 35*d* is disposed between the heat exchanger related to heat medium 15*b* and the expansion device 16*b*.

A pressure sensor 36*b* is disposed between the heat exchanger related to heat medium 15*b* and the expansion device 16*b*, similar to the installation position of the third temperature sensor 35*d*, and is configured to detect a pressure of the heat source side refrigerant flowing between the heat exchanger related to heat medium 15*b* and the expansion device 16*b*. A pressure sensor 36*a* is disposed between the heat exchanger related to heat medium 15*a* and the second refrigerant flow switching device 18*a*, similarly to the installation position of the third temperature sensor 35*a*, and is configured to detect a pressure of the heat source side refrigerant flowing between the heat exchanger related to heat medium 15*a* and the second refrigerant flow switching device 18*a*.

The heat medium relay unit 3 further includes a controller (not illustrated) that includes a microcomputer. The controller controls the devices in the heat medium relay unit 3, for example, driving of the pumps 21, the opening degree of each expansion device 16, opening and closing of each opening and closing device 17, switching by each second refrigerant flow switching device 18, switching by each first heat medium flow switching device 22, switching by each second heat medium flow switching device 23, and the opening degree of each heat medium flow control device 25 on the basis of information items detected by the various detection devices and an instruction from the remote control, thus controlling any of the operation modes, which will be described later. Although the controller for controlling the devices in the heat medium relay unit 3 is independently disposed, the controller may be combined with the above-described controller 50 and be disposed in either the outdoor unit 1 or the heat medium relay unit 3.

The pipes 5 for conveying the heat medium include the pipes connected to the heat exchanger related to heat medium 15*a* and the pipes connected to the heat exchanger related to heat medium 15*b*. Each pipe 5 branches into pipes (four pipes in this case) in accordance with the number of indoor units 2 connected to the heat medium relay unit 3. The pipes 5 are connected via the first heat medium flow switching devices 22 and the second heat medium flow switching devices 23. Controlling each first heat medium flow switching device 22 and each second heat medium flow switching device 23 determines whether the heat medium flowing from the heat exchanger related to heat medium 15*a* is allowed to flow into the corresponding use side heat exchanger 26 and whether the heat medium flowing from the heat exchanger related to heat medium 15*b* is allowed to flow into the corresponding use side heat exchanger 26.

In the air-conditioning apparatus 100, the compressor 10, the first refrigerant flow switching device 11, the heat source side heat exchanger 12, the opening and closing devices 17, the second refrigerant flow switching devices 18, a refrigerant passage of the heat exchanger related to heat medium 15*a*, the expansion devices 16, and the accumulator 19 are connected by the refrigerant pipes 4, thus forming the refrigerant circuit A. In addition, a heat medium passage of the heat exchanger related to heat medium 15*a*, the pumps 21, the first heat medium flow switching devices 22, the heat medium flow control devices 25, the use side heat exchangers 26, and the second heat medium flow switching devices 23 are connected by the pipes 5, thus forming the heat medium circuits B. The plurality of use side heat exchangers 26 are connected in parallel with each of the heat exchangers related to heat medium 15 and switching by each flow switching device is performed, so that a plurality of heat medium circuits B can be provided.

Accordingly, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are also connected through the heat exchanger related to heat medium 15*a* and the heat exchanger related to heat medium 15*b*. Consequently, in the air-conditioning apparatus 100, each of the heat exchanger related to heat medium 15*a* and the heat exchanger related to heat medium 15*b* can exchange heat between the heat source side refrigerant circulating in the refrigerant circuit A and the heat medium circulating in the heat medium circuits B.

The operation modes performed by the air-conditioning apparatus 100 will now be described. The air-conditioning apparatus 100 enables each indoor unit 2, on the basis of an instruction from the indoor unit 2, to select a cooling operation or heating operation. Accordingly, the air-conditioning apparatus 100 enables all of the indoor units 2 to perform the same operation and also enables the indoor units 2 to perform different operations.

The operation modes performed by the air-conditioning apparatus 100 include the cooling only operation mode in which all of the operating indoor units 2 perform the cooling operation and only a cooling load is generated and the heating only operation mode in which all of the operating indoor units 2 perform the heating operation and only a heating load is generated. The operation modes further include the cooling main operation mode in which the indoor units 2 perform different operations and a cooling load is larger and the heating main operation mode in which a heating load is larger. The operation modes will be described below in association with the flow of the heat source side refrigerant and the flow of the heat medium. Note that pressure loss (pressure loss caused by rapid increase and rapid decrease of the flow of the refrigerant through a narrow passage) occurs at the opening of the compression chamber upon injection of the refrigerant into the compression chamber from the injection pipe 4*c* connected to the opening of the compression chamber of the compressor 10. The presence or absence of the pressure loss does not affect the advantages of the present invention. For easy understanding about operation, pressure loss at the opening will be ignored (disregarded intentionally) in the following description.

[Cooling Only Operation Mode]

Figure 4:
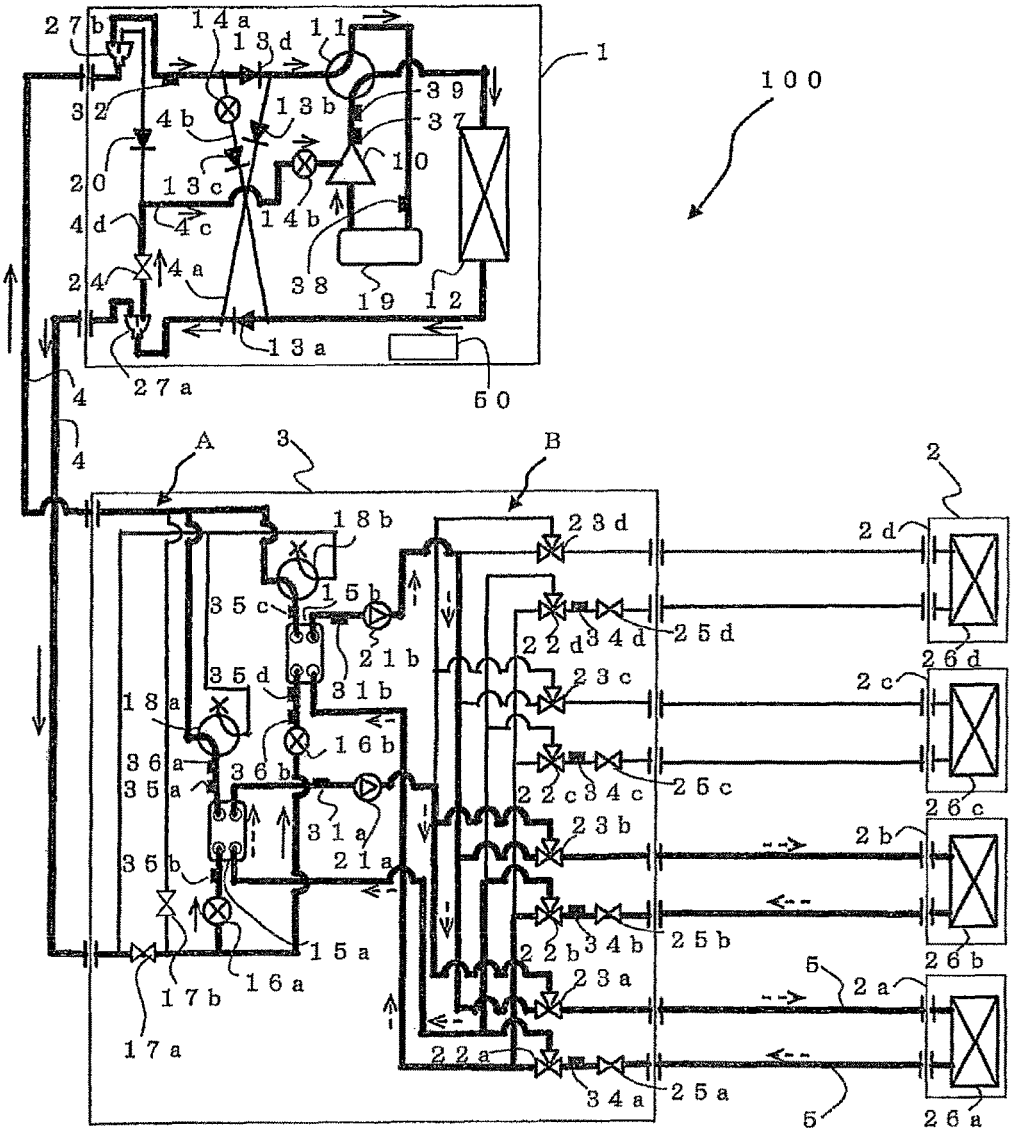
FIG. 4 is a diagram illustrating a circuit configuration of the air-conditioning apparatus according to Embodiment 1 of the present invention in a cooling only operation.

FIG. 4 is a refrigerant circuit diagram illustrating the flows of the refrigerants in the cooling only operation mode of the air-conditioning apparatus 100. The cooling only operation mode will be described with respect to a case where a cooling load is generated only in the use side heat exchanger 26*a* and the use side heat exchanger 26*b* in FIG. 4. In FIG. 4, pipes indicated by thick lines correspond to pipes through which the refrigerants (the heat source side refrigerant and the heat medium) flow. Furthermore, in FIG. 4, solid-line arrows indicate a flow direction of the heat source side refrigerant and broken-line arrows indicate a flow direction of the heat medium.

In the cooling only operation mode illustrated in FIG. 4, in the outdoor unit 1, the first refrigerant flow switching device 11 is allowed to perform switching such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger related to heat medium 15*a* and the use side heat exchangers 26*a* and 26*b* and also circulates between the heat exchanger related to heat medium 15*b* and the use side heat exchangers 26*a* and 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant condenses and liquefies while transferring heat to outdoor air in the heat source side heat exchanger 12, such that it turns into a high-pressure liquid refrigerant. The high-pressure liquid refrigerant, which has flowed out of the heat source side heat exchanger 12, passes through the check valve 13*a*, flows through the branching portion 27*a* and out of the outdoor unit 1, passes through the refrigerant pipe 4, and flows into the heat medium relay unit 3. The high-pressure liquid refrigerant, which has flowed into the heat medium relay unit 3, passes through the opening and closing device 17*a* and is then divided into flows to the expansion device 16*a* and the expansion device 16*b*, in each of which the refrigerant is expanded into a low-temperature low-pressure two-phase refrigerant.

These flows of two-phase refrigerant enter the heat exchanger related to heat medium 15*a* and the heat exchanger related to heat medium 15*b*, functioning as evaporators, in each of which the refrigerant absorbs heat from the heat medium circulating in the heat medium circuits B to cool the heat medium, and thus turns into a low-temperature low-pressure gas refrigerant. The gas refrigerant, which has flowed from the heat exchanger related to heat medium 15*a* and the heat exchanger related to heat medium 15*b*, flows through the second refrigerant flow switching device 18*a* and the second refrigerant flow switching device 18*b* and out of the heat medium relay unit 3, passes through the refrigerant pipe 4, and again flows into the outdoor unit 1. The heat source side refrigerant, which has flowed into the outdoor unit 1, passes through the branching portion 27*b*, the check valve 13*d*, the first refrigerant flow switching device 11, and the accumulator 19, and is then again sucked into the compressor 10.

At this time, the opening degree (opening area) of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, the superheat being obtained as the difference between a temperature detected by the third temperature sensor 35*c* and that detected by the third temperature sensor 35*d*. The opening and closing device 17*a* is opened and the opening and closing device 17*b* is closed.

Figure 5:
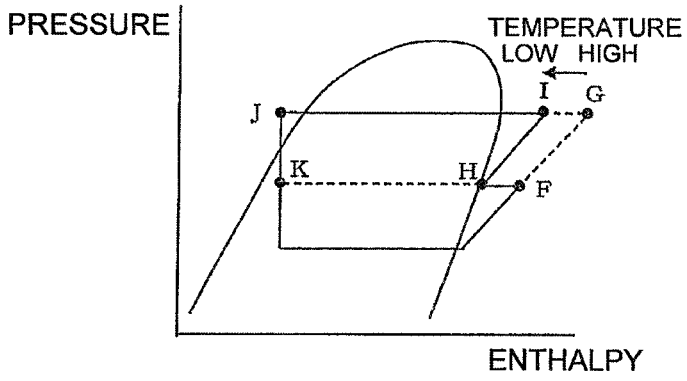
FIG. 5 is a p-h diagram (pressure-enthalpy diagram) in the cooling only operation of the air-conditioning apparatus according to Embodiment 1 of the present invention.

FIG. 5 is a graph illustrating a p-h diagram (pressure-enthalpy diagram) in the cooling only operation mode according to Embodiment 1. As described above, since the discharge temperature of the compressor 10 is high in the use of R32 as the heat source side refrigerant, the air-conditioning apparatus 100 performs an operation for reducing the discharge temperature using the injection circuit. This operation and related matters will be described with reference to FIGS. 4 and 5.

In the compressor 10, a low-temperature low-pressure gas refrigerant sucked through a suction inlet of the compressor 10 is supplied into the sealed container. The low-temperature low-pressure gas refrigerant, with which the sealed container is filled, is sucked into the compression chamber (not illustrated). The compression chamber is gradually reduced in internal volume during a 0 degree to 360 degree rotation by a motor (not illustrated), so that the heat source side refrigerant inside the compression chamber is compressed such that its pressure and temperature rise. The compressor 10 is configured such that when the angle of rotation by the motor reaches a predetermined angle, the opening is opened (such a state corresponds to point F in FIG. 5) and the inside of the compression chamber communicates with the injection pipe 4*c* outside the compressor 10. In the cooling only operation mode, the heat source side refrigerant compressed by the compressor 10 is condensed and liquefied into a high-pressure liquid refrigerant (at point J in FIG. 5) in the heat source side heat exchanger 12 and passes through the check valve 13*a* and then reaches the branching portion 27*a*. The injection opening and closing device 24 is opened to allow the flow of the high-pressure liquid refrigerant to be divided into parts by the branching portion 27*a* such that one part flows through the injection opening and closing device 24 and the branch pipe 4*d* into the injection pipe 4*c*. The one part of the refrigerant is pressure-reduced by the expansion device 14*b* such that it turns into a low-temperature intermediate-pressure two-phase refrigerant (at point K in FIG. 5). The refrigerant is allowed to flow through the opening of the compression chamber of the compressor 10 into the compression chamber. In the compression chamber, the intermediate-pressure gas refrigerant (at point F in FIG. 5) is mixed with the low-temperature, intermediate-pressure two-phase refrigerant (at point K in FIG. 5), so that the temperature of the heat source side refrigerant falls. The temperature at this time reaches a temperature at point H in FIG. 5. Thus, the discharge temperature of the heat source side refrigerant discharged from the compressor 10 decreases. The discharge temperature of the compressor 10 upon injection corresponds to point I in FIG. 5. Furthermore, the discharge temperature of the compressor 10 without injection corresponds to point G in FIG. 5. It is therefore apparent that injection enables the discharge temperature to decrease from the temperature at point G to the temperature at point I.

At this time, the heat source side refrigerant in a passage from the injection opening and closing device 24 to the backflow prevention device 20 in the branch pipe 4*d* is a high-pressure refrigerant. The heat source side refrigerant, which has returned from the heat medium relay unit 3 through the refrigerant pipe 4 to the outdoor unit and has then reached the branching portion 27*b*, is a low-pressure refrigerant. The backflow prevention device 20 is configured to prevent the heat source side refrigerant from flowing from the branch pipe 4*d* to the branching portion 27*b*. The high-pressure refrigerant in the branch pipe 4*d* is prevented from mixing with the low-pressure refrigerant in the branching portion 27*b* by working of the backflow prevention device 20.

The injection opening and closing device 24 may be a component, such as a solenoid valve, capable of switching between opening and closing. Alternatively, if being capable of switching between passing and blocking of the refrigerant, the injection opening and closing device 24 may be a component, such as an electronic expansion valve, capable of changing the opening area. The backflow prevention device 20 may be a check valve, a component, such as a solenoid valve, capable of switching between opening and closing, or a component, such as an electronic expansion valve, capable of changing the opening area and switching between opening and closing of a passage. In the cooling only operation, the heat source side refrigerant does not flow through the expansion device 14*a*. Accordingly, the opening degree of the expansion device 14*a* may be set to any opening degree. If the expansion device 14*b* is a component, such as an electronic expansion valve, capable of changing the opening degree, the controller 50 controls the opening area of the expansion device 14*b* so that the discharge temperature, to be detected by the refrigerant discharge temperature detection device 37, of the compressor 10 does not become too high. As regards how to control the expansion device 14*b*, the opening degree thereof may be controlled such that when it is determined that the discharge temperature exceeds a predetermined value (for example, 110° C.), the expansion device 14*b* is opened by a predetermined opening degree, for example, ten pulses. Alternatively, the opening degree of the expansion device 14*b* may be controlled so that the discharge temperature reaches a target value (e.g., 100° C.). Furthermore, the expansion device 14*b* may be a capillary tube, such that the amount of heat source side refrigerant depending on a pressure difference is injected.

Next, the flow of the heat medium in the heat medium circuits B will be described.

In the cooling only operation mode, both the heat exchanger related to heat medium 15*a* and the heat exchanger related to heat medium 15*b* transfer cooling energy of the heat source side refrigerant to the heat medium and the pump 21*a* and the pump 21*b* allow the cooled heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium absorbs heat from indoor air through each of the use side heat exchanger 26*a* and the use side heat exchanger 26*b*, thus cooling the indoor space 7.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, each of the heat medium flow control device 25*a* and the heat medium flow control device 25*b* allows the heat medium to be controlled at a flow rate necessary to cover an air conditioning load required in the indoor space, such that the controlled flow rate of heat medium flows into the corresponding one of the use side heat exchanger 26*a* and the use side heat exchanger 26*b*. The heat medium, which has flowed out of the heat medium flow control device 25*a* and the heat medium flow control device 25*b*, passes through the first heat medium flow switching device 22*a* and the first heat medium flow switching device 22*b*, flows into the heat exchanger related to heat medium 15*a* and the heat exchanger related to heat medium 15*b*, and is then again sucked into the pump 21*a* and the pump 21*b*.

Note that in the pipe 5 in each use side heat exchanger 26, the heat medium flows in a direction in which it flows from the second heat medium flow switching device 23 through the heat medium flow control device 25 to the first heat medium flow switching device 22. Furthermore, the difference between a temperature detected by the first temperature sensor 31*a* or that detected by the first temperature sensor 31*b* and a temperature detected by the second temperature sensor 34 is controlled such that the difference is held at a target value, so that the air conditioning load required in the indoor space 7 can be covered. As regards a temperature on the outlet side of the heat exchangers related to heat medium 15, either of the temperature detected by the first temperature sensor 31*a* and that detected by the first temperature sensor 31*b* may be used. Alternatively, the mean temperature of them may be used. At this time, the first heat medium flow switching devices 22 and the second heat medium flow switching devices 23 are controlled at an intermediate opening degree such that passages to both the heat exchanger related to heat medium 15*a* and the heat exchanger related to heat medium 15*b* are established.

Figure 8:
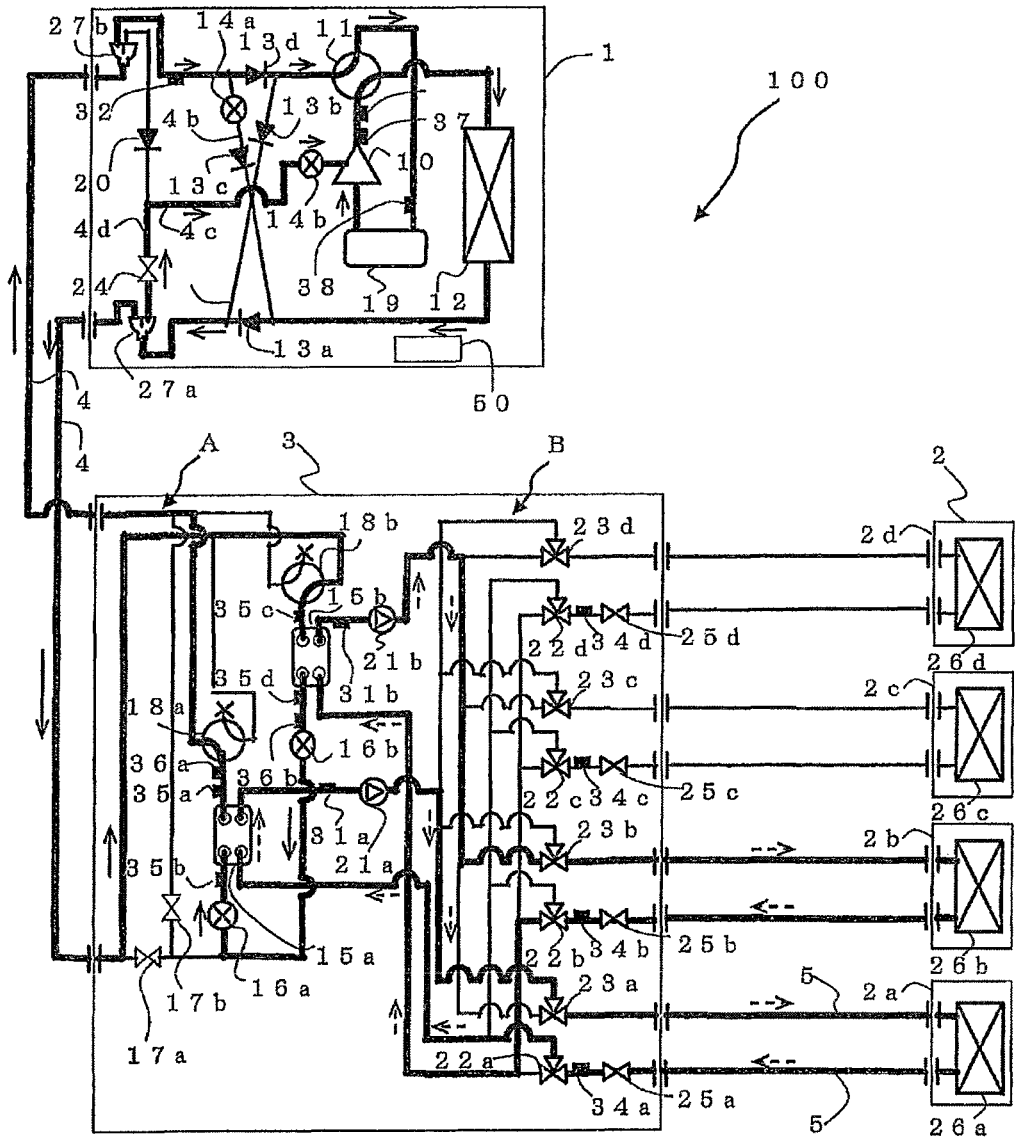
FIG. 8 is a diagram illustrating a circuit configuration of the air-conditioning apparatus according to Embodiment 1 of the present invention in a cooling main operation.

To perform the cooling only operation mode, it is unnecessary to supply the heat medium to each use side heat exchanger 26 having no thermal load (including thermo-off). Accordingly, the corresponding heat medium flow control device 25 is closed to block the passage such that the heat medium does not flow into the use side heat exchanger 26. In FIG. 8, the heat medium flows into the use side heat exchanger 26*a* and the use side heat exchanger 26*b* because these heat exchangers each have a thermal load. The use side heat exchanger 26*c* and the use side heat exchanger 26*d* have no thermal load and the corresponding heat medium flow control devices 25*c* and 25*d* are fully closed. When a thermal load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 6:
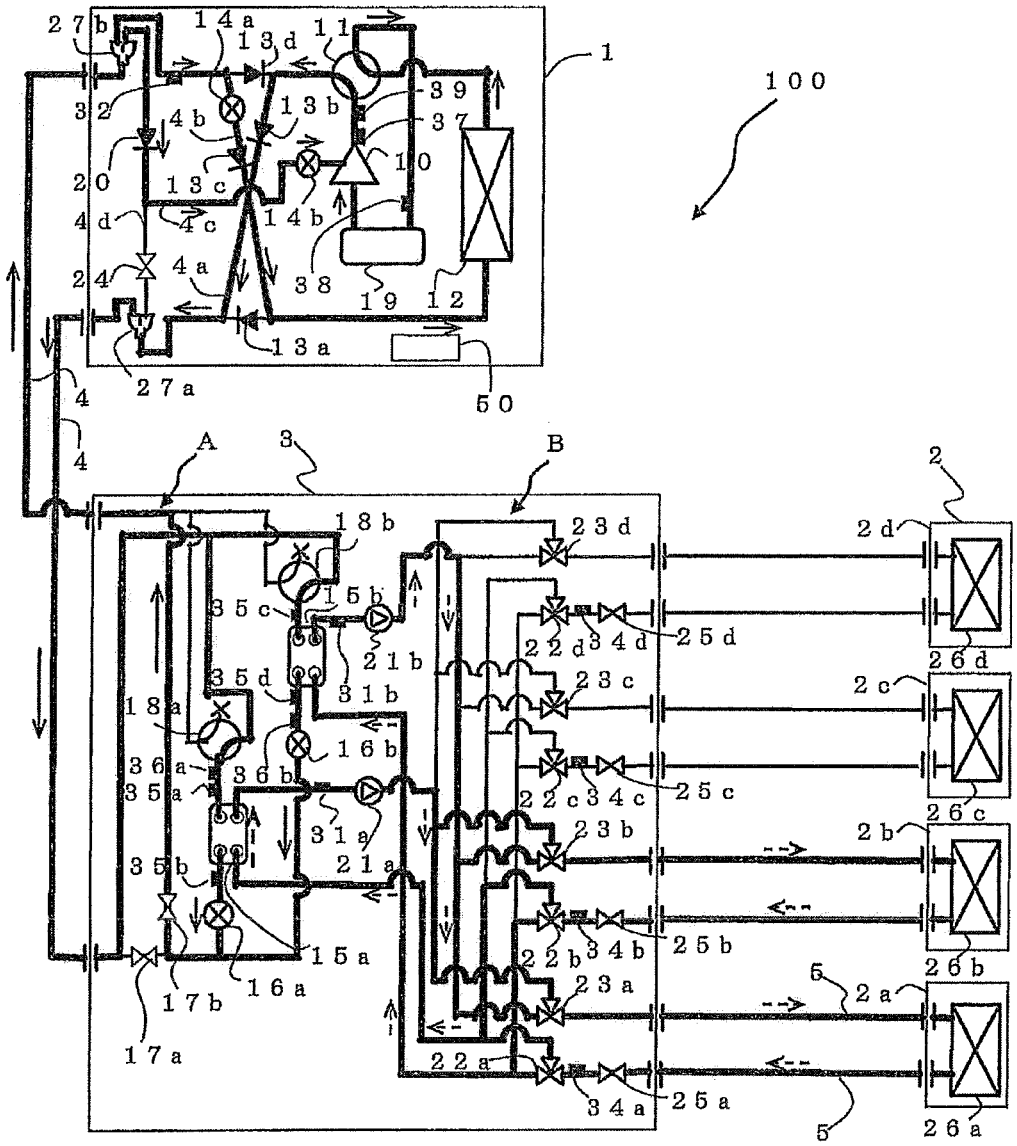
FIG. 6 is a diagram illustrating a circuit configuration of the air-conditioning apparatus according to Embodiment 1 of the present invention in a heating only operation.

FIG. 6 is a refrigerant circuit diagram illustrating the flows of the refrigerants in the heating only operation mode of the air-conditioning apparatus 100. The heating only operation mode will be described with respect to a case where a heating load is generated only in the use side heat exchanger 26*a* and the use side heat exchanger 26*b* in FIG. 6. In FIG. 6, pipes indicated by thick lines correspond to pipes through which the refrigerants (the heat source side refrigerant and the heat medium) flow. Furthermore, in FIG. 6, solid-line arrows indicate a flow direction of the heat source side refrigerant and broken-line arrows indicate a flow direction of the heat medium.

In the heating only operation mode illustrated in FIG. 6, in the outdoor unit 1, the first refrigerant flow switching device 11 is allowed to perform switching such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger related to heat medium 15*a* and the use side heat exchangers 26*a* and 26*b* and also circulates between the heat exchanger related to heat medium 15*b* and the use side heat exchangers 26*a* and 26*b*.

First, the flow of the heat source side refrigerant in the refrigerant circuit A will be described.

A low-temperature low-pressure heat source side refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b* and the branching portion 27*a*, and flows out of the outdoor unit 1. The high-temperature high-pressure gas refrigerant, which has flowed out of the outdoor unit 1, passes through the refrigerant pipe 4 and flows into the heat medium relay unit 3. The high-temperature high-pressure gas refrigerant, which has flowed into the heat medium relay unit 3, is divided into flows such that the flows pass through the second refrigerant flow switching device 18*a* and the second refrigerant flow switching device 18*b* and then enter the heat exchanger related to heat medium 15*a* and the heat exchanger related to heat medium 15*b*.

The high-temperature high-pressure gas refrigerant, which has flowed into the heat exchanger related to heat medium 15*a* and the heat exchanger related to heat medium 15*b*, condenses and liquefies while transferring heat to the heat medium circulating in the heat medium circuits B, such that it turns into a high-pressure liquid refrigerant. The liquid refrigerant flowing from the heat exchanger related to heat medium 15*a* and that flowing from the heat exchanger related to heat medium 15*b* are expanded into an intermediate-temperature, intermediate-pressure two-phase refrigerant or liquid refrigerant by the expansion device 16*a* and the expansion device 16*b*, respectively. This two-phase refrigerant or liquid refrigerant passes through the opening and closing device 17*b*, flows out of the heat medium relay unit 3, passes through the refrigerant pipe 4, and again flows into the outdoor unit 1. The heat source side refrigerant, which has flowed into the outdoor unit 1, flows through the branching portion 27*b* into the second connecting pipe 4*b*, passes through the expansion device 14*a* while the flow of the refrigerant is being regulated by the expansion device 14*a* such that it turns into a low-temperature low-pressure two-phase refrigerant, passes through the check valve 13*c*, and flows into the heat source side heat exchanger 12, functioning as an evaporator.

The heat source side refrigerant, which has flowed into the heat source side heat exchanger 12, absorbs heat from the outdoor air in the heat source side heat exchanger 12, such that it turns into a low-temperature low-pressure gas refrigerant. The low-temperature low-pressure gas refrigerant, which has flowed out of the heat source side heat exchanger 12, passes through the first refrigerant flow switching device 11 and the accumulator 19 and is again sucked into the compressor 10.

At this time, the opening degree of the expansion device 16*a* is controlled such that subcooling (the degree of subcooling) is constant, the subcooling being obtained as the difference between a saturation temperature converted from a pressure detected by the pressure sensor 36 and a temperature detected by the third temperature sensor 35*b*. Similarly, the opening degree of the expansion device 16*b* is controlled such that subcooling is constant, the subcooling being obtained as the difference between the saturation temperature converted from the pressure detected by the pressure sensor 36 and a temperature detected by the third temperature sensor 35*d*. The opening and closing device 17*a* is closed and the opening and closing device 17*b* is opened. Note that if a temperature at the middle position of each heat exchanger related to heat medium 15 can be measured, the temperature at the middle position may be used instead of the pressure sensor 36. Thus, such a system can be constructed inexpensively.

Figure 7:
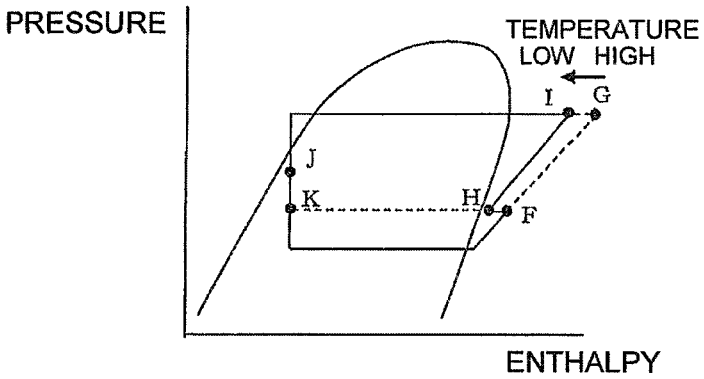
FIG. 7 is a p-h diagram (pressure-enthalpy diagram) in the cooling only operation of the air-conditioning apparatus according to Embodiment 1 of the present invention.

FIG. 7 is a graph illustrating a p-h diagram (pressure-enthalpy diagram) in the heating only operation mode according to Embodiment 1. Since the discharge temperature of the compressor 10 is high in the use of R32 as the heat source side refrigerant, the air-conditioning apparatus 100 performs the operation for reducing the discharge temperature using the injection circuit in the same way as in the cooling only operation mode. This operation and related matters will be described with reference to FIGS. 6 and 7.

In the compressor 10, a low-temperature low-pressure gas refrigerant sucked through the suction inlet of the compressor 10 is supplied into the sealed container. The low-temperature low-pressure gas refrigerant, with which the sealed container is filled, is sucked into the compression chamber (not illustrated). The compression chamber is gradually reduced in internal volume during a 0 degree to 360 degree rotation by the motor (not illustrated), so that the heat source side refrigerant inside the compression chamber is compressed such that its pressure and temperature rise. The compressor 10 is configured such that when the angle of rotation by the motor reaches a predetermined angle, the opening is opened (such a state corresponds to point F in FIG. 7) and the inside of the compression chamber communicates with the injection pipe 4*c* outside the compressor 10.

In the heating only operation mode, the heat source side refrigerant returning from the heat medium relay unit 3 through the refrigerant pipe 4 to the outdoor unit 1 flows through the branching portion 27*b* into the expansion device 14*a*. The pressure of the heat source side refrigerant on an upstream side of the expansion device 14*a* is controlled in an intermediate-pressure state (at point J in FIG. 7) by working of the expansion device 14*a*. The flow of the two-phase refrigerant or liquid refrigerant, which has been made in the intermediate-pressure state by the expansion device 14*a*, is divided into parts by the branching portion 27*b* such that one part flows into the branch pipe 4*d* and then flows through the backflow prevention device 20 into the injection pipe 4*c*. The one part of the refrigerant is pressure-reduced by the expansion device 14*b* such that it turns into a low-temperature intermediate-pressure two-phase refrigerant whose pressure is slightly lower (at point K in FIG. 7). The refrigerant flows through the opening of the compression chamber of the compressor 10 into the compression chamber. In the compression chamber, the intermediate-pressure gas refrigerant (at point F in FIG. 7) is mixed with the low-temperature intermediate-pressure two-phase refrigerant (at point K in FIG. 7), so that the temperature of the heat source side refrigerant falls. The temperature at this time reaches a temperature at point H in FIG. 7. Thus, the discharge temperature of the heat source side refrigerant discharged from the compressor 10 decreases. The discharge temperature of the compressor 10 upon injection corresponds to point I in FIG. 7. Furthermore, the discharge temperature of the compressor 10 without injection corresponds to point G in FIG. 7. It is therefore apparent that injection enables the discharge temperature to decrease from the temperature at point G to the temperature at point I.

In many cases (unless an intermediate-pressure is controlled at a considerably high value), the heat source side refrigerant in a two-phase state flows into the branching portion 27*b*. It is therefore desirable to divide the flow of the two-phase refrigerant equally as much as possible. The branching portion 27*b* is configured and disposed such that the flow of the heat source side refrigerant is divided into parts while the heat source side refrigerant is flowing in a direction opposite to the direction of gravity. Consequently, the flow of the two-phase refrigerant can be equally divided.

In the heating only operation mode, the injection opening and closing device 24 is closed, thereby preventing the heat source side refrigerant in a high-pressure state flowing from the branching portion 27*a* from mixing with the heat source side refrigerant in an intermediate-pressure state which has passed through the backflow prevention device 20. The injection opening and closing device 24 may be a component, such as a solenoid valve, capable of switching between opening and closing. Alternatively, if being capable of switching between passing and blocking of the refrigerant, the injection opening and closing device 24 may be a component, such as an electronic expansion valve, capable of changing the opening area.

The backflow prevention device 20 may be a check valve, a component, such as a solenoid valve, capable of switching between opening and closing, or a component, such as an electronic expansion valve, capable of changing the opening area to switch between opening and closing of a passage. Preferably, the expansion device 14*a* is a component, such as an electronic expansion valve, capable of changing the opening area. If an electronic expansion valve is used, an intermediate pressure on the upstream side of the expansion device 14*a* can be controlled to be at any value. For example, if an intermediate pressure detected by the intermediate-pressure detection device 32 is controlled to be at a constant value, discharge temperature control through the expansion device 14*b* can be stabilized. The expansion device 14*a*, however, is not limited to an electronic expansion valve. The expansion device 14*a* may include a combination of small on-off valves, such as solenoid valves, to provide a plurality of selectable opening areas or may be a capillary tube to provide an intermediate pressure depending on pressure loss of the heat source side refrigerant. Although controllability is slightly deteriorated in such a configuration, the discharge temperature can be controlled at a target value.

The intermediate-pressure detection device 32 may include a pressure sensor and a temperature sensor. For example, the controller 50 may calculate an intermediate pressure on the basis of a temperature detected by this temperature sensor. If the expansion device 14*b* is a component, such as an electronic expansion valve, capable of changing the opening area, the controller 50 controls the opening area of the expansion device 14*b* so that the discharge temperature of the compressor 10 detected by the refrigerant discharge temperature detection device 37 does not become too high. As regards how to control the expansion device 14*b*, the opening degree thereof may be controlled such that when it is determined that the discharge temperature exceeds a predetermined value (for example, 110° C.), the expansion device 14*b* is opened by a predetermined opening degree, for example, ten pulses. Alternatively, the opening degree of the expansion device 14*b* may be controlled so that the discharge temperature reaches a target value (e.g., 100° C.). Furthermore, the expansion device 14*b* may be a capillary tube, such that the amount of heat source side refrigerant depending on a pressure difference is injected.

In the heating only operation mode, the heat medium is heated by both the heat exchanger related to heat medium 15*a* and the heat exchanger related to heat medium 15*b*. Accordingly, the pressure (intermediate pressure) of the heat source side refrigerant on the upstream side of the expansion device 14*a* may be controlled to be slightly higher as long as the expansion device 16*a* and the expansion device 16*b*, namely, subcooling can be controlled. If the intermediate pressure is controlled to be slightly higher, the pressure difference between the intermediate pressure and a pressure inside the compression chamber can be increased. Thus, the amount of heat source side refrigerant to be injected into the compression chamber can be increased. If the outdoor air temperature is low, therefore, an amount of injection enough to reduce the discharge temperature can be supplied to the compression chamber.

The control of the expansion device 14*a* and the expansion device 14*b* by the controller 50 is not limited to the above manner. For example, the expansion device 14*b* may be fully opened and the discharge temperature of the compressor 10 may be controlled alone by the expansion device 14*a*. This control manner allows the control to be simplified. In addition, advantageously, an inexpensive device can be used as the expansion device 14*b*.

Next, the flow of the heat medium in the heat medium circuits B will be described.

In the heating only operation mode, both the heat exchanger related to heat medium 15*a* and the heat exchanger related to heat medium 15*b* transfer heating energy of the heat source side refrigerant to the heat medium and the pump 21*a* and the pump 21*b* allow the heated heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium transfers heat to the indoor air through each of the use side heat exchanger 26*a* and the use side heat exchanger 26*b*, thus heating the indoor space 7.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, each of the heat medium flow control device 25*a* and the heat medium flow control device 25*b* allows the heat medium to be controlled at a flow rate necessary to cover an air conditioning load required in the indoor space, such that the controlled flow rate of heat medium flows into the corresponding one of the use side heat exchanger 26*a* and the use side heat exchanger 26*b*. The heat medium, which has flowed out of the heat medium flow control device 25*a* and the heat medium flow control device 25*b*, passes through the first heat medium flow switching device 22*a* and the first heat medium flow switching device 22*b*, flows into the heat exchanger related to heat medium 15*a* and the heat exchanger related to heat medium 15*b*, and is then again sucked into the pump 21*a* and the pump 21*b*.

Note that in the pipe 5 in each use side heat exchanger 26, the heat medium flows in the direction in which it flows from the second heat medium flow switching device 23 through the heat medium flow control device 25 to the first heat medium flow switching device 22. Furthermore, the difference between a temperature detected by the first temperature sensor 31*a* or that detected by the first temperature sensor 31*b* and a temperature detected by the second temperature sensor 34 is controlled such that the difference is held at a target value, so that the air conditioning load required in the indoor space 7 can be covered. As regards a temperature on the outlet side of the heat exchangers related to heat medium 15, either of the temperature detected by the first temperature sensor 31*a* and that detected by the first temperature sensor 31*b* may be used. Alternatively, the mean temperature of them may be used.

At this time, the first heat medium flow switching devices 22 and the second heat medium flow switching devices 23 are controlled at an intermediate opening degree such that passages to both the heat exchanger related to heat medium 15*a* and the heat exchanger related to heat medium 15*b* are established. Although the use side heat exchanger 26*a* should essentially be controlled on the basis of the difference between a temperature at the inlet and that at the outlet, a temperature of the heat medium on the inlet side of the use side heat exchanger 26 is substantially the same as a temperature detected by the first temperature sensor 31*b*, and the use of the first temperature sensor 31*b* therefore can reduce the number of temperature sensors, so that the system can be constructed inexpensively.

To perform the heating only operation mode, it is unnecessary to supply the heat medium to each use side heat exchanger 26 having no thermal load (including thermo-off). Accordingly, the corresponding heat medium flow control device 25 is closed to block the passage such that the heat medium does not flow into the use side heat exchanger 26. In FIG. 6, the heat medium flows into the use side heat exchanger 26*a* and the use side heat exchanger 26*b* because these heat exchangers each have a thermal load. The use side heat exchanger 26*c* and the use side heat exchanger 26*d* have no thermal load and the corresponding heat medium flow control devices 25*c* and 25*d* are fully closed. When a thermal load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

FIG. 8 is a refrigerant circuit diagram illustrating the flows of the refrigerants in the cooling main operation mode of the air-conditioning apparatus 100. The cooling main operation mode will be described with respect to a case where a cooling load is generated in the use side heat exchanger 26*a* and a heating load is generated in the use side heat exchanger 26*b* in FIG. 8. In FIG. 8, pipes indicated by thick lines correspond to pipes through which the refrigerants (the heat source side refrigerant and the heat medium) circulate. Furthermore, in FIG. 8, solid-line arrows indicate a flow direction of the heat source side refrigerant and broken-line arrows indicate a flow direction of the heat medium.

In the cooling main operation mode illustrated in FIG. 8, in the outdoor unit 1, the first refrigerant flow switching device 11 is allowed to perform switching such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger related to heat medium 15*a* and the use side heat exchanger 26*a* and the heat medium circulates between the heat exchanger related to heat medium 15*b* and the use side heat exchanger 26*b*.

First, the flow of the heat source side refrigerant in the refrigerant circuit A will be described.

A low-temperature low-pressure heat source side refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant condenses into a two-phase refrigerant in the heat source side heat exchanger 12 while transferring heat to the outdoor air. The two-phase refrigerant, which has flowed out of the heat source side heat exchanger 12, passes through the check valve 13*a*, flows through the branching portion 27*a* and out of the outdoor unit 1, passes through the refrigerant pipe 4, and flows into the heat medium relay unit 3. The two-phase refrigerant, which has flowed into the heat medium relay unit 3, passes through the second refrigerant flow switching device 18*b* and flows into the heat exchanger related to heat medium 15*b*, functioning as a condenser.

The two-phase refrigerant, which has flowed into the heat exchanger related to heat medium 15*b*, condenses and liquefies while transferring heat to the heat medium circulating in the heat medium circuit B, such that it turns into a liquid refrigerant. The liquid refrigerant, which has flowed out of the heat exchanger related to heat medium 15*b*, is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant, which has flowed into the heat exchanger related to heat medium 15*a*, absorbs heat from the heat medium circulating in the heat medium circuit B to cool the heat medium, and thus turns into a low-pressure gas refrigerant. The gas refrigerant flows out of the heat exchanger related to heat medium 15*a*, flows through the second refrigerant flow switching device 18*a* and out of the heat medium relay unit 3, passes through the refrigerant pipe 4, and again flows into the outdoor unit 1. The heat source side refrigerant, which has flowed into the outdoor unit 1, passes through the branching portion 27*b* and the check valve 13*d*, the first refrigerant flow switching device 11, and the accumulator 19, and is then again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. The expansion device 16*a* is fully opened, the opening and closing device 17*a* is closed, and the opening and closing device 17*b* is closed. Furthermore, the opening degree of the expansion device 16*b* may be controlled such that subcooling is constant, the subcooling being obtained as the difference between a saturation temperature converted from a pressure detected by the pressure sensor 36 and a temperature detected by the third temperature sensor 35*d*. Alternatively, the expansion device 16*b* may be fully opened and the superheat or subcooling may be controlled through the expansion device 16*a*.

Figure 9:
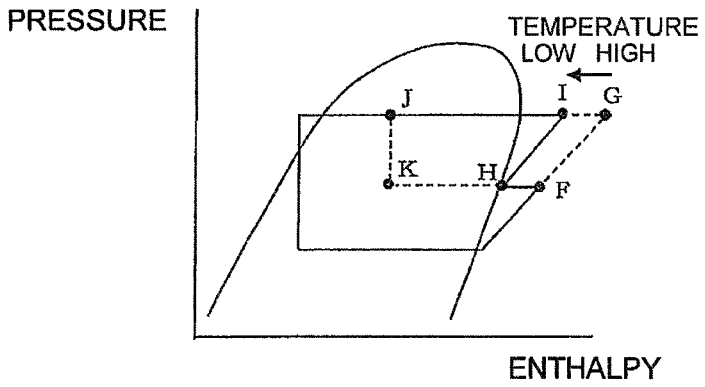
FIG. 9 is a p-h diagram (pressure-enthalpy diagram) in the cooling main operation of the air-conditioning apparatus according to Embodiment 1 of the present invention.

FIG. 9 is a graph illustrating a p-h diagram (pressure-enthalpy diagram) in the cooling main operation mode according to Embodiment 1. As described above, since the discharge temperature of the compressor 10 is high in the use of R32 as the heat source side refrigerant, the air-conditioning apparatus 100 performs the operation for reducing the discharge temperature using the injection circuit. This operation and related matters will be described with reference to FIGS. 8 and 9.

In the compressor 10, a low-temperature low-pressure gas refrigerant sucked through the suction inlet of the compressor 10 is supplied into the sealed container. The low-temperature low-pressure gas refrigerant, with which the sealed container is filled, is sucked into the compression chamber (not illustrated). The compression chamber is gradually reduced in internal volume during a 0 degree to 360 degree rotation by the motor (not illustrated), so that the heat source side refrigerant inside the compression chamber is compressed such that its pressure and temperature rise. The compressor 10 is configured such that when the angle of rotation by the motor reaches a predetermined angle, the opening is opened (such a state corresponds to point F in FIG. 9) and the inside of the compression chamber communicates with the injection pipe 4*c* outside the compressor 10. In the cooling main operation mode, the heat source side refrigerant compressed by the compressor 10 is condensed into a high-pressure two-phase refrigerant (at point J in FIG. 9) in the heat source side heat exchanger 12 and passes through the check valve 13*a* and then reaches the branching portion 27*a*. The injection opening and closing device 24 is opened to allow the flow of the high-pressure two-phase refrigerant to be divided into parts by the branching portion 27*a* such that one part flows through the injection opening and closing device 24 and the branch pipe 4*d* into the injection pipe 4*c*. The one part of the refrigerant is pressure-reduced by the expansion device 14*b* such that it turns into a low-temperature intermediate-pressure two-phase refrigerant (at point K in FIG. 9). The refrigerant is allowed to flow through the opening of the compression chamber of the compressor 10 into the compression chamber. In the compression chamber, the intermediate-pressure gas refrigerant (at point F in FIG. 9) is mixed with the low-temperature intermediate-pressure two-phase refrigerant (at point K in FIG. 9), so that the temperature of the heat source side refrigerant falls. The temperature at this time reaches a temperature at point H in FIG. 9. Thus, the discharge temperature of the heat source side refrigerant discharged from the compressor 10 decreases. The discharge temperature of the compressor 10 upon injection corresponds to point I in FIG. 9. Furthermore, the discharge temperature of the compressor 10 without injection corresponds to point G in FIG. 9. It is therefore apparent that injection enables the discharge temperature to decrease from the temperature at point G to the temperature at point I.

Since the heat source side refrigerant in a two-phase state flows into the branching portion 27*a*, it is desirable to divide the refrigerant equally as much as possible. The branching portion 27*a* is therefore configured and disposed such that the flow of the heat source side refrigerant is divided into parts while the heat source side refrigerant is flowing in the direction opposite to the direction of gravity. Consequently, the two-phase refrigerant can be equally divided.

At this time, the heat source side refrigerant in the passage from the injection opening and closing device 24 to the backflow prevention device 20 in the branch pipe 4*d* is a high-pressure refrigerant. The heat source side refrigerant, which has returned from the heat medium relay unit 3 through the refrigerant pipe 4 to the outdoor unit 1 and has then reached the branching portion 27*b*, is a low-pressure refrigerant. The backflow prevention device 20 is configured to prevent the heat source side refrigerant from flowing to the branching portion 27*b* through the branch pipe 4*d*. The high-pressure refrigerant in the branch pipe 4*d* is prevented from mixing with the low-pressure refrigerant in the branching portion 27*b* by working of the backflow prevention device 20.

The injection opening and closing device 24 may be a component, such as a solenoid valve, capable of switching between opening and closing. Alternatively, if being capable of switching between passing and blocking of the refrigerant, the injection opening and closing device 24 may be a component, such as an electronic expansion valve, capable of changing the opening area. The backflow prevention device 20 may be a check valve, a component, such as a solenoid valve, capable of switching between opening and closing, or a component, such as an electronic expansion valve, capable of changing the opening area to switch between opening and closing of a passage. Furthermore, since the heat source side refrigerant does not flow through the expansion device 14*a* in the cooling main operation, the opening degree of the expansion device 14*a* may be set to any opening degree. If the expansion device 14*b* is a component, such as an electronic expansion valve, capable of changing the opening area, the controller 50 controls the opening area of the expansion device 14*b* so that the discharge temperature of the compressor 10 detected by the refrigerant discharge temperature detection device 37 becomes too high. As regards how to control the expansion device 14*b*, the opening degree thereof may be controlled such that when it is determined that the discharge temperature exceeds a predetermined value (for example, 110° C.), the expansion device 14*b* is opened by a predetermined opening degree, for example, ten pulses. Alternatively, the opening degree of the expansion device 14*b* may be controlled so that the discharge temperature reaches a target value (e.g., 100° C.). Furthermore, the expansion device 14*b* may be a capillary tube, such that the amount of heat source side refrigerant depending on a pressure difference is injected.

Next, the flow of the heat medium in the heat medium circuits B will be described.

In the cooling main operation mode, the heat exchanger related to heat medium 15*b* transfers heating energy of the heat source side refrigerant to the heat medium and the pump 21*b* allows the heated heat medium to flow through the pipes 5. Furthermore, in the cooling main operation mode, the heat exchanger related to heat medium 15*a* transfers cooling energy of the heat source side refrigerant to the heat medium and the pump 21*a* allows the cooled heat medium to flow through the pipes 5. The heat medium, which has flowed out of each of the pump 21*a* and the pump 21*b* while being pressurized, flows through the corresponding one of the second heat medium flow switching device 23*a* and the second heat medium flow switching device 23*b* into the corresponding one of the use side heat exchanger 26*a* and the use side heat exchanger 26*b*.

In the use side heat exchanger 26*b*, the heat medium transfers heat to the indoor air, thus heating the indoor space 7. In addition, in the use side heat exchanger 26*a*, the heat medium absorbs heat from the indoor air, thus cooling the indoor space 7. At this time, each of the heat medium flow control device 25*a* and the heat medium flow control device 25*b* allows the heat medium to be controlled at a flow rate necessary to cover an air conditioning load required in the indoor space, such that the controlled flow rate of heat medium flows into the corresponding one of the use side heat exchanger 26*a* and the use side heat exchanger 26*b*. The heat medium, which has passed through the use side heat exchanger 26*b* with a slight decrease of temperature, passes through the heat medium flow control device 25*b* and the first heat medium flow switching device 22*b*, flows into the heat exchanger related to heat medium 15*b*, and is then again sucked into the pump 21*b*. The heat medium, which has passed through the use side heat exchanger 26*a* with a slight increase of temperature, passes through the heat medium flow control device 25*a* and the first heat medium flow switching device 22*a*, flows into the heat exchanger related to heat medium 15*a*, and is then again sucked into the pump 21*a*.

Throughout this mode, the first heat medium flow switching devices 22 and the second heat medium flow switching devices 23 allow the warm heat medium and the cold heat medium to be supplied into the use side heat exchanger 26 having the heating load and the use side heat exchanger 26 having the cooling load, respectively, without mixing with each other. Note that in the pipe 5 in each of the use side heat exchanger 26 for heating and that for cooling, the heat medium flows in the direction in which it flows from the second heat medium flow switching device 23 through the heat medium flow control device 25 to the first heat medium flow switching device 22. Furthermore, the difference between a temperature detected by the first temperature sensor 31*b* and a temperature detected by the second temperature sensor 34 is controlled such that the difference is held at a target value, so that an air conditioning load required in the indoor space 7 to be heated can be covered. The difference between the temperature detected by the second temperature sensor 34 and a temperature detected by the first temperature sensor 31*a* is controlled such that the difference is held at a target value, so that an air conditioning load required in the indoor space 7 to be cooled can be covered.

To perform the cooling main operation mode, it is unnecessary to supply the heat medium to each use side heat exchanger 26 having no thermal load (including thermo-off). Accordingly, the corresponding heat medium flow control device 25 is closed to block the passage such that the heat medium does not flow into the use side heat exchanger 26. In FIG. 8, the heat medium flows into the use side heat exchanger 26*a* and the use side heat exchanger 26*b* because these heat exchangers each have a thermal load. The use side heat exchanger 26*c* and the use side heat exchanger 26*d* have no thermal load and the corresponding heat medium flow control devices 25*c* and 25*d* are fully closed. When a thermal load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 10:
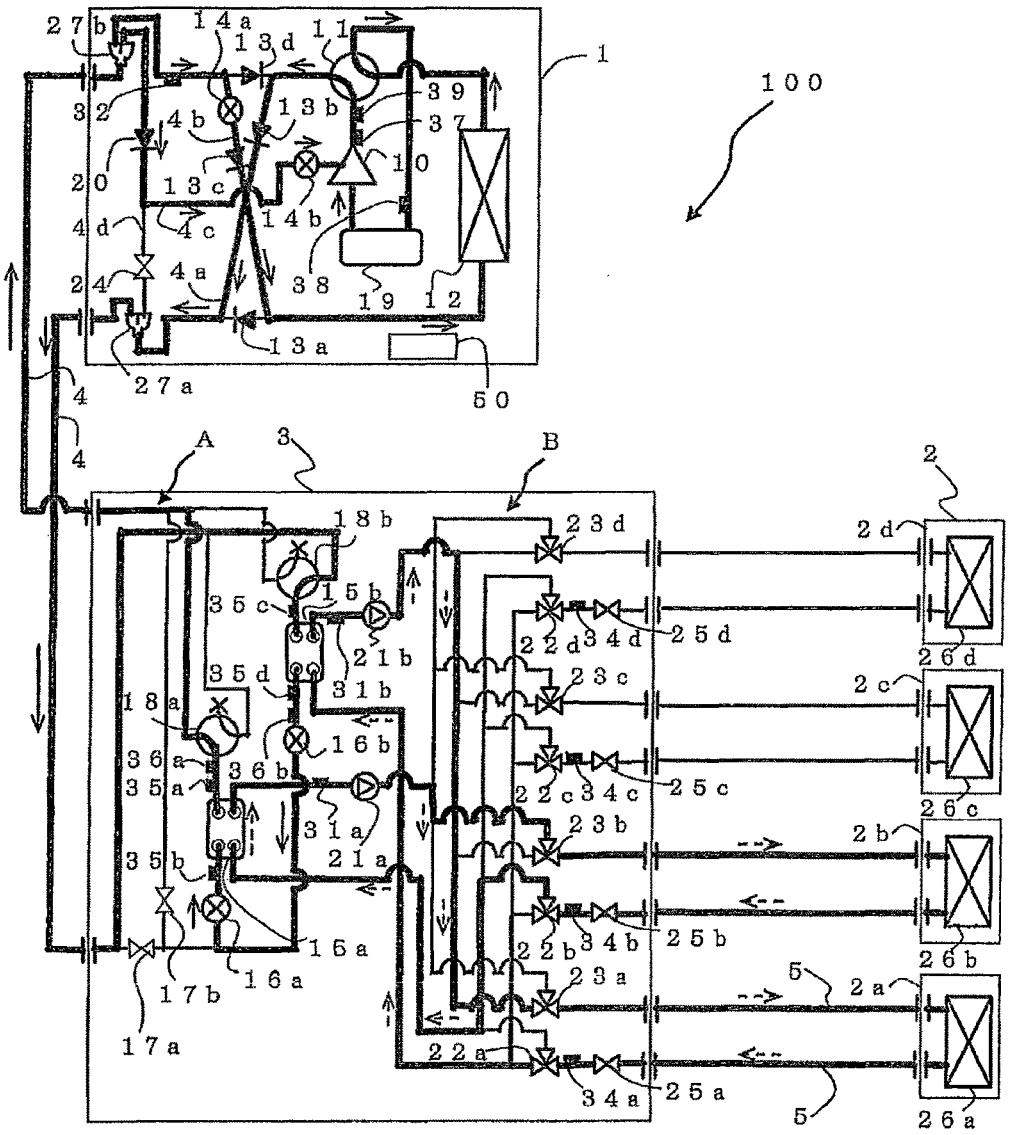
FIG. 10 is a diagram illustrating a circuit configuration of the air-conditioning apparatus according to Embodiment 1 of the present invention in a heating main operation.

FIG. 10 is a refrigerant circuit diagram illustrating the flows of the refrigerants in the heating main operation mode of the air-conditioning apparatus 100. The heating main operation mode will be described with respect to a case where a heating load is generated in the use side heat exchanger 26*a* and a cooling load is generated in the use side heat exchanger 26*b* in FIG. 10. In FIG. 10, pipes indicated by thick lines correspond to pipes through which the refrigerants (the heat source side refrigerant and the heat medium) circulate. Furthermore, in FIG. 10, solid-line arrows indicate a flow direction of the heat source side refrigerant and broken-line arrows indicate a flow direction of the heat medium.

In the heating main operation mode illustrated in FIG. 10, in the outdoor unit 1, the first refrigerant flow switching device 11 is allowed to perform switching such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger related to heat medium 15*a* and the use side heat exchanger 26*b* and the heat medium circulates between the heat exchanger related to heat medium 15*b* and the use side heat exchanger 26*a*.

First, the flow of the heat source side refrigerant in the refrigerant circuit A will be described.

A low-temperature low-pressure heat source side refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b*, and flows through the branching portion 27*a* and out of the outdoor unit 1. The high-temperature high-pressure gas refrigerant, which has flowed out of the outdoor unit 1, passes through the refrigerant pipe 4 and flows into the heat medium relay unit 3. The high-temperature high-pressure gas refrigerant, which has flowed into the heat medium relay unit 3, passes through the second refrigerant flow switching device 18*b* and flows into the heat exchanger related to heat medium 15*b*, functioning as a condenser.

The gas refrigerant, which has flowed into the heat exchanger related to heat medium 15*b*, condenses and liquefies while transferring heat to the heat medium circulating in the heat medium circuit B, such that it turns into a liquid refrigerant. The liquid refrigerant, which has flowed out of the heat exchanger related to heat medium 15*b*, is expanded into an intermediate-pressure two-phase refrigerant by the expansion device 16*b*. This intermediate-pressure two-phase refrigerant flows through the expansion device 16*a* into the heat exchanger related to heat medium 15*a*, functioning as an evaporator. The intermediate-pressure two-phase refrigerant, which has flowed into the heat exchanger related to heat medium 15*a*, absorbs heat from the heat medium circulating in the heat medium circuit B to evaporate, thus cooling the heat medium. This low-pressure two-phase refrigerant flows out of the heat exchanger related to heat medium 15*a*, passes through the second refrigerant flow switching device 18*a*, flows out of the heat medium relay unit 3, passes through the refrigerant pipe 4, and again flows into the outdoor unit 1.

The heat source side refrigerant, which has flowed into the outdoor unit 1, flows through the branching portion 27*b* into the second connecting pipe 4*b*, passes through the expansion device 14*a* while the flow of the refrigerant is being regulated by the expansion device 14*a* such that it turns into a low-temperature low-pressure two-phase refrigerant, passes through the check valve 13*c*, and flows into the heat source side heat exchanger 12, functioning as an evaporator. The heat source side refrigerant, which has flowed into the heat source side heat exchanger 12, absorbs heat from the outdoor air in the heat source side heat exchanger 12, such that it turns into a low-temperature low-pressure gas refrigerant. The low-temperature low-pressure gas refrigerant, which has flowed out of the heat source side heat exchanger 12, passes through the first refrigerant flow switching device 11 and the accumulator 19 and is again sucked into the compressor 10.

At this time, the opening degree of the expansion device 16*b* is controlled such that subcooling is constant, the subcooling being obtained as the difference between a saturation temperature converted from a pressure detected by the pressure sensor 36 and a temperature detected by the third temperature sensor 35*b*. The expansion device 16*a* is fully opened, the opening and closing device 17*a* is closed, and the opening and closing device 17*b* is closed. Note that the expansion device 16*b* may be fully opened and the subcooling may be controlled through the expansion device 16*a*.

Figure 11:
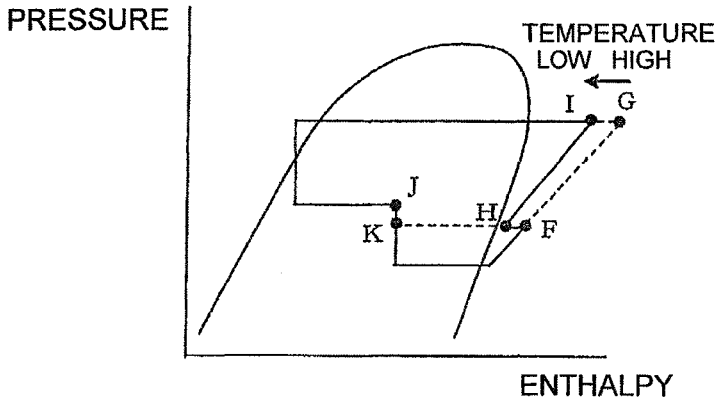
FIG. 11 is a p-h diagram (pressure-enthalpy diagram) in the heating main operation of the air-conditioning apparatus according to Embodiment 1 of the present invention.

FIG. 11 is a graph illustrating a p-h diagram (pressure-enthalpy diagram) in the heating main operation mode according to Embodiment 1. As described above, since the discharge temperature of the compressor 10 is high in the use of R32 as the heat source side refrigerant, the air-conditioning apparatus 100 performs the operation for reducing the discharge temperature using the injection circuit. This operation and related matters will be described with reference to FIGS. 10 and 11.

In the compressor 10, a low-temperature low-pressure gas refrigerant sucked through the suction inlet of the compressor 10 is supplied into the sealed container. The low-temperature low-pressure gas refrigerant, with which the sealed container is filled, is sucked into the compression chamber (not illustrated). The compression chamber is gradually reduced in internal volume during a 0 degree to 360 degree rotation by the motor (not illustrated), so that the heat source side refrigerant inside the compression chamber is compressed such that its pressure and temperature rise. The compressor 10 is configured such that when the angle of rotation by the motor reaches a predetermined angle, the opening is opened (such a state corresponds to point F in FIG. 11) and the inside of the compression chamber communicates with the injection pipe 4*c* outside the compressor 10.

In the heating main operation mode, the heat source side refrigerant returning from the heat medium relay unit 3 through the refrigerant pipe 4 to the outdoor unit 1 flows through the branching portion 27*b* into the expansion device 14*a*. The pressure of the heat source side refrigerant on the upstream side of the expansion device 14*a* is controlled in an intermediate-pressure state (at point J in FIG. 11) by working of the expansion device 14*a*. The flow of the two-phase refrigerant, which has been made in the intermediate-pressure state by the expansion device 14*a*, is divided into parts by the branching portion 27*b* such that one part flows into the branch pipe 4*d* and then flows through the backflow prevention device 20 into the injection pipe 4*c*. The one part of the refrigerant is pressure-reduced by the expansion device 14*b* such that it turns into a low-temperature intermediate-pressure two-phase refrigerant whose pressure is slightly lower (at point Kin FIG. 11). The refrigerant flows through the opening of the compression chamber of the compressor 10 into the compression chamber. In the compression chamber, the intermediate-pressure gas refrigerant (at point F in FIG. 11) is mixed with the low-temperature, intermediate-pressure two-phase refrigerant (at point K in FIG. 11), so that the temperature of the heat source side refrigerant falls. The temperature at this time reaches a temperature at point H in FIG. 11. Thus, the discharge temperature of the heat source side refrigerant discharged from the compressor 10 decreases. The discharge temperature of the compressor 10 upon injection corresponds to point I in FIG. 11. Furthermore, the discharge temperature of the compressor 10 without injection corresponds to point G in FIG. 11. It is therefore apparent that injection enables the discharge temperature to decrease from the temperature at point G to the temperature at point I.

Since the heat source side refrigerant in a two-phase state flows into the branching portion 27*b*, it is desirable to divide the refrigerant equally as much as possible. The branching portion 27*b* is therefore configured and disposed such that the flow of the heat source side refrigerant is divided into parts while the heat source side refrigerant is flowing in the direction opposite to the direction of gravity. Consequently, the two-phase refrigerant can be equally divided.

In the heating main operation mode, the injection opening and closing device 24 is closed, thereby preventing the heat source side refrigerant in a high-pressure state flowing from the branching portion 27*a* from mixing with the heat source side refrigerant in an intermediate-pressure state which has passed through the backflow prevention device 20. The injection opening and closing device 24 may be a component, such as a solenoid valve, capable of switching between opening and closing. Alternatively, if being capable of switching between passing and blocking of the refrigerant, the injection opening and closing device 24 may be a component, such as an electronic expansion valve, capable of changing the opening area.

The backflow prevention device 20 may be a check valve, a component, such as a solenoid valve, capable of switching between opening and closing, or a component, such as an electronic expansion valve, capable of changing the opening area to switch between opening and closing of a passage. Preferably, the expansion device 14*a* is a component, such as an electronic expansion valve, capable of changing the opening area. If an electronic expansion valve is used, an intermediate pressure on the upstream side of the expansion device 14*a* can be controlled at any value. For example, if an intermediate pressure detected by the intermediate-pressure detection device 32 is controlled at a constant value, discharge temperature control through the expansion device 14*b* can be stabilized. The expansion device 14*a*, however, is not limited to an electronic expansion valve. The expansion device 14*a* may include a combination of small on-off valves, such as solenoid valves, to provide a plurality of selectable opening areas or may be a capillary tube to provide an intermediate pressure depending on pressure loss of the heat source side refrigerant. Although controllability is slightly deteriorated in such a configuration, the discharge temperature can be controlled at a target value.

The intermediate-pressure detection device 32 may include a pressure sensor and a temperature sensor. For example, the controller 50 may calculate an intermediate pressure on the basis of a temperature detected by this temperature sensor. If the expansion device 14*b* is a component, such as an electronic expansion valve, capable of changing the opening degree, the controller 50 controls the opening area of the expansion device 14*b* so that the discharge temperature, to be detected by the refrigerant discharge temperature detection device 37, of the compressor 10 does not become too high. As regards how to control the expansion device 14*b*, the opening degree thereof may be controlled such that when it is determined that the discharge temperature exceeds a predetermined value (for example, 110° C.), the expansion device 14*b* is opened by a predetermined opening degree, for example, ten pulses. Alternatively, the opening degree of the expansion device 14*b* may be controlled so that the discharge temperature reaches a target value (e.g., 100° C.). Furthermore, the expansion device 14*b* may be a capillary tube, such that the amount of heat source side refrigerant depending on a pressure difference is injected.

In the heating main operation mode, the heat medium is cooled by the heat exchanger related to heat medium 15*a*. Accordingly, the pressure (intermediate pressure) of the heat source side refrigerant on the upstream side of the expansion device 14*a* cannot be controlled to be slightly higher. If the intermediate pressure cannot be controlled to be higher, the amount of heat source side refrigerant to be injected into the compression chamber will be reduced, thus diminishing a reduction in discharge temperature. Since it is necessary to prevent the heat medium from freezing, however, the operation in the heating main operation mode is not performed when the outdoor air temperature is low (for example, the outdoor air temperature is at or below −5° C.). Furthermore, when the outdoor air temperature is high, the discharge temperature is not so high. The amount of injection, therefore, may be not so much. Accordingly, there is no problem. The expansion device 14*a* enables setting of an intermediate pressure at which the heat medium can be cooled in the heat exchanger related to heat medium 15*a* and an amount of injection enough to reduce the discharge temperature can be supplied to the compression chamber. Thus, the operation can be performed safely.

The control of the expansion device 14*a* and the expansion device 14*b* by the controller 50 is not limited to the above manner. For example, the expansion device 14*b* may be fully opened and the discharge temperature of the compressor 10 may be controlled only through the expansion device 14*a*. This control manner allows the control to be simplified. In addition, advantageously, an inexpensive device can be used as the expansion device 14*b*. In this case, however, the intermediate pressure cannot be freely controlled. It is necessary to control the expansion device 14*a* while paying attention to both the intermediate pressure and the discharge temperature.

Next, the flow of the heat medium in the heat medium circuits B will be described.

In the heating main operation mode, the heat exchanger related to heat medium 15*b* transfers heating energy of the heat source side refrigerant to the heat medium and the pump 21*b* allows the heated heat medium to flow through the pipes 5. Furthermore, in the heating main operation mode, the heat exchanger related to heat medium 15*a* transfers cooling energy of the heat source side refrigerant to the heat medium and the pump 21*a* allows the cooled heat medium to flow through the pipes 5. The heat medium, which has flowed out of each of the pump 21*a* and the pump 21*b* while being pressurized, flows through the corresponding one of the second heat medium flow switching device 23*a* and the second heat medium flow switching device 23*b* into the corresponding one of the use side heat exchanger 26*a* and the use side heat exchanger 26*b*.

In the use side heat exchanger 26*b*, the heat medium absorbs heat from the indoor air, thus cooling the indoor space 7. In addition, in the use side heat exchanger 26*a*, the heat medium transfers heat to the indoor air, thus heating the indoor space 7. At this time, each of the heat medium flow control device 25*a* and the heat medium flow control device 25*b* allows the heat medium to be controlled at a flow rate necessary to cover an air conditioning load required in the indoor space, such that the controlled flow rate of heat medium flows into the corresponding one of the use side heat exchanger 26*a* and the use side heat exchanger 26*b*. The heat medium, which has passed through the use side heat exchanger 26*b* with a slight increase of temperature, passes through the heat medium flow control device 25*b* and the first heat medium flow switching device 22*b*, flows into the heat exchanger related to heat medium 15*a*, and is then again sucked into the pump 21*a*. The heat medium, which has passed through the use side heat exchanger 26*a* with a slight decrease of temperature, passes through the heat medium flow control device 25*a* and the first heat medium flow switching device 22*a*, flows into the heat exchanger related to heat medium 15*b*, and is then again sucked into the pump 21*b*.

Throughout this mode, the first heat medium flow switching devices 22 and the second heat medium flow switching devices 23 allow the warm heat medium and the cold heat medium to be supplied into the use side heat exchanger 26 having the heating load and the use side heat exchanger 26 having the cooling load, respectively, without mixing with each other. Note that in the pipe 5 in each of the use side heat exchanger 26 for heating and that for cooling, the heat medium flows in the direction in which it flows from the second heat medium flow switching device 23 through the heat medium flow control device 25 to the first heat medium flow switching device 22. Furthermore, the difference between a temperature detected by the first temperature sensor 31*b* and a temperature detected by the second temperature sensor 34 is controlled such that the difference is held at a target value, so that an air conditioning load required in the indoor space 7 to be heated can be covered. The difference between the temperature detected by the second temperature sensor 34 and a temperature detected by the first temperature sensor 31*a* is controlled such that the difference is held at a target value, so that an air conditioning load required in the indoor space 7 to be cooled can be covered.

To perform the heating main operation mode, it is unnecessary to supply the heat medium to each use side heat exchanger 26 having no thermal load (including thermo-off). Accordingly, the corresponding heat medium flow control device 25 is closed to block the passage such that the heat medium does not flow into the use side heat exchanger 26. In FIG. 10, the heat medium flows into the use side heat exchanger 26*a* and the use side heat exchanger 26*b* because these heat exchangers each have a thermal load. The use side heat exchanger 26*c* and the use side heat exchanger 26*d* have no thermal load and the corresponding heat medium flow control devices 25*c* and 25*d* are fully closed. When a thermal load is generated in the use side heat exchanger 26*c* or the use side heat exchanger 26*d*, the heat medium flow control device 25*c* or the heat medium flow control device 25*d* may be opened such that the heat medium is circulated.

[Expansion Device 14*a* or/and Expansion Device 14*b*]

The operations in the operation modes and the injection into the compression chamber of the compressor 10 are performed as described above. Accordingly, a two-phase refrigerant flows into the expansion device 14*a* in the heating only operation mode and the heating main operation mode. A liquid refrigerant flows into the expansion device 14*b* in the cooling only operation mode. A two-phase heat source side refrigerant flows into the expansion device 14*b* in the cooling main operation mode, the heating only operation mode, and the heating main operation mode. In the use of an electronic expansion valve as the expansion device 14*a* or/and the expansion device 14*b* (herein referred to as the "expansion device 14"), if the heat source side refrigerant in a two-phase state flows into the expansion device such that the gas refrigerant and the liquid refrigerant are flowing separately, a gas flowing state and a liquid flowing state may occur independently in an expansion portion, thus resulting in an unstable pressure on an outlet side of the expansion device. Particularly, low quality is more likely to cause the separation between the gas refrigerant and the liquid refrigerant and in turn cause an unstable pressure.

Figure 12:
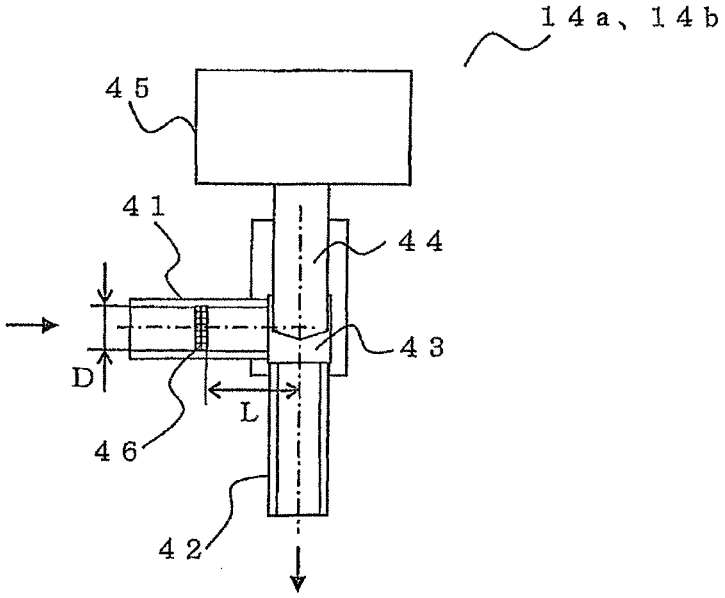
FIG. 12 is a schematic diagram illustrating a configuration of an expansion device of the air-conditioning apparatus according to Embodiment 1 of the present invention.

FIG. 12 illustrates a structure of the expansion device 14*a* or/and the expansion device 14*b*. As illustrated in FIG. 12, each expansion device 14 includes an inlet pipe 41, an outlet pipe 42, an expansion portion (intermediate-pressure refrigerant expansion portion or injection refrigerant expansion portion) 43, a valve body 44, a motor 45, and an agitator 46. The agitator (intermediate-pressure refrigerant agitator or injection refrigerant agitator) 46 is disposed in the inlet pipe 41. The two-phase refrigerant flowing into the inlet pipe 41 reaches the agitator 46. The gas refrigerant and the liquid refrigerant are agitated by working of the agitator 46, so that these refrigerants are substantially uniformly mixed. The flow of the two-phase refrigerant, in which the gas refrigerant and the liquid refrigerant are substantially uniformly mixed, is regulated by the valve body 44 in the expansion portion 43 such that the pressure is reduced. Then, the resulting refrigerant flows out of the outlet pipe 42. At this time, the motor 45 controls the position of the valve body 44 to control the amount of flow regulation in the expansion portion 43. The controller 50 controls the motor 45. This structure enables flow control of the two-phase refrigerant while avoiding an unstable pressure.

The agitator 46 may be any component capable of producing a state in which the gas refrigerant and the liquid refrigerant are substantially uniformly mixed. For example, foam metal can be used to achieve such a state. Foam metal is a porous metal that has a three-dimensional network structure like foam resin, such as sponge, and has the highest porosity (percentage of voids) (80% to 97%) among porous metals. When the two-phase refrigerant flows through the foam metal, the three-dimensional network structure affects the gas contained in the heat source side refrigerant such that the gas is fined and the refrigerant is agitated. Advantageously, the gas is uniformly mixed with the liquid. As regards flow inside a pipe, it has been found in the field of fluid dynamics that the flow is not affected by disturbance in a position at a distance of L/D in the range of 8 to 10, where D denotes an inside diameter of the pipe and L denotes the length of the pipe, from an object having a flow disturbing structure and the flow therefore returns to its initial state. Accordingly, when D denotes an inside diameter of the inlet pipe of the expansion device 14 and L denotes a distance between the agitator 46 and the expansion portion 43, the agitator 46 is disposed at a position at which L/D is less than or equal to 6. Consequently, the two-phase refrigerant agitated by the agitator 46 is allowed to reach the expansion portion 43 while being agitated, so that control can be stabilized.

[Refrigerant Pipes 4]

As described above, the air-conditioning apparatus 100 according to Embodiment 1 has the several operation modes. In these operation modes, the heat source side refrigerant flows through the refrigerant pipes 4 connecting the outdoor unit 1 and the heat medium relay unit 3.

[Pipes 5]

In the several operation modes performed by the air-conditioning apparatus 100 according to Embodiment 1, the heat medium, such as water or antifreeze, flows through the pipes 5 connecting the heat medium relay unit 3 and the indoor units 2.

A defrosting operation will be described below.

In the heating only operation mode and the heating main operation mode, the heat source side refrigerant at a low pressure and a low temperature below freezing flows through a pipe in the heat source side heat exchanger 12, serving as an evaporator. Accordingly, if the temperature of air surrounding the heat source side heat exchanger 12 is low, frost occurs on the heat source side heat exchanger 12. Upon the occurrence of frost on the heat source side heat exchanger 12, a frost layer acts as a thermal resistance and a passage through which the air surrounding the heat source side heat exchanger 12 flows is narrowed, so that the air becomes difficult to flow. Disadvantageously, heat exchange between the heat source side refrigerant and the air is hindered, thus reducing the heating capacity of such a device and operation efficiency. If frost on the heat source side heat exchanger 12 increases, therefore, the defrosting operation for melting frost on the heat source side heat exchanger 12 is performed.

Figure 13:
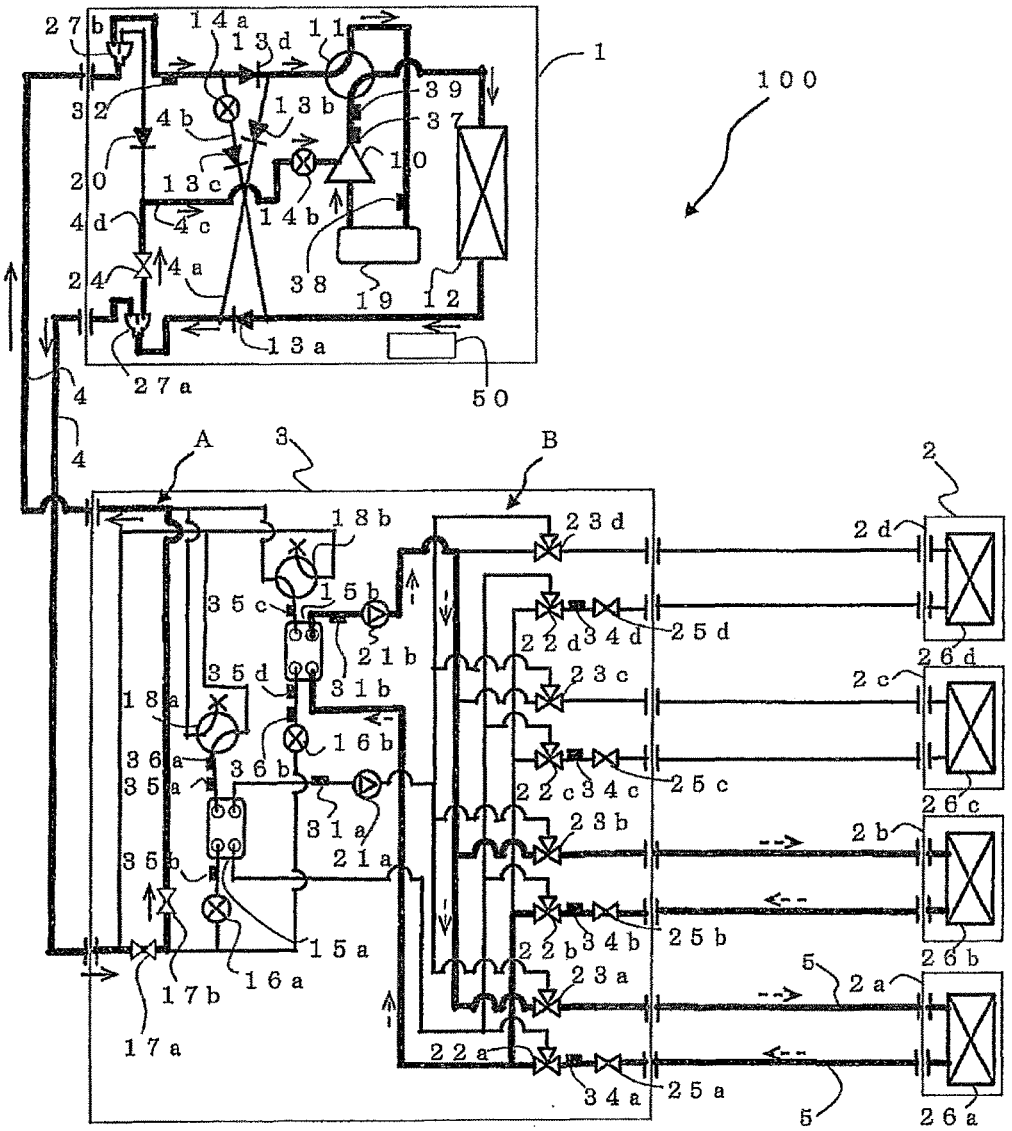
FIG. 13 is a diagram illustrating a circuit configuration of the air-conditioning apparatus according to Embodiment 1 of the present invention in a defrosting operation.

FIG. 13 is a refrigerant circuit diagram illustrating the flows of the refrigerants in the defrosting operation of the air-conditioning apparatus 100. The defrosting operation in Embodiment 1 will be described with reference to FIG. 13.

The heat source side refrigerant is compressed to be heated by the compressor 10 and is discharged from the compressor 10 and flows through the first refrigerant flow switching device 11 into the heat source side heat exchanger 12. The refrigerant transfers heat in the heat source side heat exchanger 12 to melt frost deposited on the heat source side heat exchanger 12. The heat source side refrigerant, which has flowed out of the heat source side heat exchanger 12, passes through the check valve 13*a* and reaches the branching portion 27*a*, in which the flow of the refrigerant is divided into parts.

One part of the flow divided by the branching portion 27*a* flows out of the outdoor unit 1, passes though the refrigerant pipe 4, and flows into the heat medium relay unit 3. The heat source side refrigerant, which has flowed into the heat medium relay unit 3, passes through the opening and closing device 17*a* in an opened state and the opening and closing device 17*b* in an opened state, flows out of the heat medium relay unit 3, passes through the refrigerant pipe 4, and again flows into the outdoor unit 1. The heat source side refrigerant, which has flowed into the outdoor unit 1, passes through branching portion 27*b*, the check valve 13*d*, the first refrigerant flow switching device 11, and the accumulator 19, and is then again sucked into the compressor 10. At this time, the expansion device 16*a* and the expansion device 16*b* are fully closed or each have a small opening degree at which the heat source side refrigerant does not flow so that the heat source side refrigerant does not flow through the heat exchanger related to heat medium 15*a* and the heat exchanger related to heat medium 15*b*.

The other part of the flow divided by the branching portion 27*a* flows into the branch pipe 4*d*, passes through the injection opening and closing device 24 in an opened state, flows into the injection pipe 4*c*, passes through the expansion device 14*b* in a fully opened state, and is injected into the compression chamber of the compressor 10, so that the other part merges with the heat source side refrigerant (the one part of the flow divided by the branching portion 27*a*) which has passed through the accumulator 19 and been sucked into the compressor 10.

In FIG. 13, the pump 21*b* is driven such that the heat medium is circulated to the use side heat exchangers 26 (26*a* and 26*b*) having a heating request. Consequently, the heating operation can be continued using heating energy stored in the heat medium even in the defrosting operation. Furthermore, during defrosting following the heating only operation, the pump 21*a* may be driven. In the defrosting operation, the pump 21*a* and the pump 21*b* may be stopped to stop the heating operation.

As described above, in the defrosting operation, while frost deposited on the heat source side heat exchanger 12 is being melted, the flow of the heat source side refrigerant is divided into parts by the branching portion 27*a* and one part of the heat source side refrigerant is injected to the compression chamber of the compressor 10. Consequently, heat remaining in the compressor 10 can be easily transferred directly to the heat source side refrigerant, so that the defrosting operation can be performed efficiently. In addition, the flow rate of the refrigerant circulated to the heat medium relay unit 3 apart from the outdoor unit 1 can be reduced by the amount of injection, so that power for the compressor 10 can be reduced.

As described above, according to Embodiment 1, for example, the expansion devices 14*a* and 14*b* enable the heat source side refrigerant to pass through the injection pipe 4*c* and be injected into the compressor 1 having a low-pressure shell structure, irrespective of any of the cooling only operation mode and the cooling main operation mode in which the heat source side heat exchanger functions as a condenser, and the heating only operation mode and the heating main operation mode in which the heat source side heat exchanger functions as an evaporator. For example, in the use of a heat source side refrigerant that may cause a high discharge temperature of the compressor 1, the discharge temperature can be controlled so as not to become too high in any operation mode (operation pattern). The heat source side refrigerant and a refrigerating machine oil are prevented from deteriorating. Thus, the air-conditioning apparatus 100 capable of performing a safe operation can be provided. This is especially effective against a heat source side refrigerant that may cause higher discharge temperature than R410A, for example, R32 which has a lower global warming potential than R410A and is therefore environmentally useful, a refrigerant mixture of R32 and HFO1234yf in which the mass percent of R32 is greater than or equal to 62%, or a refrigerant mixture of R32 and HFO1234ze in which the mass percent of R32 is greater than or equal to 43%.

The branching portion 27*a* divides the flow of the heat source side refrigerant flowing from the heat source side heat exchanger 12 to the heat medium relay unit 3 (the heat exchangers related to heat medium 15) into parts and the branching portion 27*b* divides the flow of the heat source side refrigerant flowing from the heat medium relay unit 3 to the heat source side heat exchanger 12 into parts, such that one part of the heat source side refrigerant flows through the branch pipe 4*d* into the injection pipe 4*c*. Thus, the heat source side refrigerant can be injected irrespective of any operation mode. Each of the branching portions 27*a* and 27*b* is configured and disposed such that the flow of the heat source side refrigerant is divided into part while the refrigerant is flowing in the direction opposite to the direction of gravity. Advantageously, the two-phase refrigerant can be more equally divided.

In addition, since the expansion devices 14*a* and 14*b* each include the agitator 46, the two-phase refrigerant can be agitated. Since the distance between the expansion portion 43 and the agitator 46 is set to be less than or equal to six times the inside diameter of the inlet pipe, the refrigerant can be allowed to pass through the expansion device 14 while being kept agitated. Since the agitator 46 includes porous metal (foam metal) having a porosity of 80% or higher, the heat source side refrigerant can be agitated with a simple structure.

To perform the defrosting operation, one part of the heat source side refrigerant which has passed through the heat source side heat exchanger 12 is allowed to pass through the injection pipe 4*c* and return to the compressor 10 through the opening, so that heat remaining in the compressor 10 can be easily transferred directly to the heat source side refrigerant. Thus, the defrosting operation can be performed efficiently. In addition, since the amount of heat source side refrigerant flowing to the heat medium relay unit 3 can be reduced, power for the compressor 10 in the defrosting operation can be reduced. At this time, the heat source side refrigerant can be circulated without flowing through the heat exchanger related to heat medium 15*a* and the heat exchanger related to heat medium 15*b*. Accordingly, the heating operation can be continued using heating energy stored in the heat medium in the heat medium circuit B even in the defrosting operation.

The above description has been made with respect to the case where the pressure sensor 36*a* is disposed in a passage between the heat exchanger related to heat medium 15*a*, acting on a cooling side in the cooling and heating mixed operation, and the second refrigerant flow switching device 18*a* and the pressure sensor 36*b* is disposed in a passage between the heat exchanger related to heat medium 15*b*, working on a heating side in the cooling and heating mixed operation, and the expansion device 16*b*. In this arrangement, a saturation temperature can be accurately calculated even if a pressure loss occurs in the heat exchangers related to heat medium 15*a* and 15*b*. Since the pressure loss on a condensing side is small, the pressure sensor 36*b* may be disposed in the passage between the heat exchanger related to heat medium 15*b* and the expansion device 16*b*. The accuracy of calculation would not be so degraded. An evaporator exhibits a relatively large pressure loss. For example, in the use of heat exchangers related to heat medium whose amount of pressure loss can be estimated or which exhibit a small pressure loss, the pressure sensor 36*a* may be disposed in the passage between the heat exchanger related to heat medium 15*a* and the second refrigerant flow switching device 18*a*.

In the air-conditioning apparatus 100, while only the heating load or cooling load is generated in the use side heat exchangers 26, the corresponding first heat medium flow switching devices 22 and the corresponding second heat medium flow switching devices 23 are controlled at an intermediate opening degree, such that the heat medium flows into both the heat exchanger related to heat medium 15*a* and the heat exchanger related to heat medium 15*b*. Consequently, since both the heat exchanger related to heat medium 15*a* and the heat exchanger related to heat medium 15*b* can be used for the heating operation or the cooling operation, the area of heat transfer is increased, so that the heating operation or the cooling operation can be performed efficiently.

While the heating load and the cooling load are simultaneously generated in the use side heat exchangers 26, the first heat medium flow switching device 22 and the second heat medium flow switching device 23 corresponding to the use side heat exchanger 26 which performs the heating operation are switched to the passage connected to the heat exchanger related to heat medium 15*b* for heating, and the first heat medium flow switching device 22 and the second heat medium flow switching device 23 corresponding to the use side heat exchanger 26 which performs the cooling operation are switched to the passage connected to the heat exchanger related to heat medium 15*a* for cooling, so that the heating operation or cooling operation can be freely performed in each indoor unit 2.

Furthermore, each of the first heat medium flow switching devices 22 and the second heat medium flow switching devices 23 described in Embodiment 1 may include a component which can switch between passages, for example, a three-way valve capable of switching between flow directions in a three-way passage or two two-way valves, such as on-off valves, opening or closing a two-way passage used in combination. Alternatively, as each of the first heat medium flow switching devices 22 and the second heat medium flow switching devices 23, a component, such as a stepping-motor-driven mixing valve, capable of changing a flow rate in a three-way passage may be used, or, two components, such as electronic expansion valves, capable of changing a flow rate in a two-way passage may be used in combination. In this case, water hammer caused when a passage is suddenly opened or closed can be prevented. Furthermore, although Embodiment 1 has been described with respect to the case where the heat medium flow control devices 25 each comprise a two-way valve, each of the heat medium flow control devices 25 may comprise a control valve having a three-way passage and the valve may be disposed with a bypass pipe that bypasses the corresponding use side heat exchanger 26.

Furthermore, as regards each of the heat medium flow control devices 25, a component capable of controlling a flow rate in a passage in a stepping-motor-driven manner may be used. Alternatively, a two-way valve or a three-way valve whose one end is closed may be used. Alternatively, as regards each of the heat medium flow control devices 25, a component, such as an on-off valve, opening or closing a two-way passage may be used such that an average flow rate is controlled while ON and OFF operations are repeated.

Furthermore, although each second refrigerant flow switching device 18 is illustrated as a four-way valve, the device is not limited to this valve. A plurality of two-way or three-way flow switching valves may be used such that the heat source side refrigerant flows in the same way.

In addition, it is needless to say that the same holds true for the case where one use side heat exchanger 26 and one heat medium flow control device 25 are connected. Moreover, obviously, no problem will arise if a plurality of components working in the same way are arranged as each of the heat exchanger related to heat medium 15 and the expansion device 16. Furthermore, although the case where the heat medium flow control devices 25 are arranged in the heat medium relay unit 3 has been described, the arrangement is not limited to this case. Each heat medium flow control device 25 may be disposed in the indoor unit 2. The heat medium relay unit 3 may be separated from the indoor unit 2.

As regards the heat medium, for example, brine (antifreeze), water, a mixed solution of brine and water, or a mixed solution of water and an additive with a high corrosion protection effect can be used. In the air-conditioning apparatus 100, therefore, if the heat medium leaks through the indoor unit 2 into the indoor space 7, the safety of the heat medium used is high. Accordingly, it contributes to safety improvement.

Typically, each of the heat source side heat exchanger 12 and the use side heat exchangers 26*a* to 26*d* is provided with the fan and a current of air often facilitates condensation or evaporation. The structure is not limited to this case. For example, a heat exchanger, such as a panel heater, using radiation can be used as each of the use side heat exchangers 26*a* to 26*d* and a water-cooled heat exchanger which transfers heat using water or antifreeze can be used as the heat source side heat exchanger 12. Any heat exchanger configured to be capable of transferring heat or removing heat can be used as each of the heat source side heat exchanger 12 and the use side heat exchangers 26*a* to 26*d*.

Although Embodiment 1 has been described with respect to the case where the four use side heat exchangers 26*a* to 26*d* are arranged, any number of use side heat exchangers may be connected.

In addition, although Embodiment 1 has been described with respect to the case where the two heat exchangers related to heat medium 15*a* and 15*b* are arranged, the arrangement is obviously not limited to this case. As long as each heat exchanger related to heat medium 15 is configured to be capable of cooling or/and heating the heat medium, the number of heat exchangers related to heat medium 15 arranged is not limited.

Furthermore, as regards each of the pumps 21*a* and 21*b*, the number of pumps is not limited to one. A plurality of pumps having a small capacity may be arranged in parallel.

Embodiment 2

Figure 14:
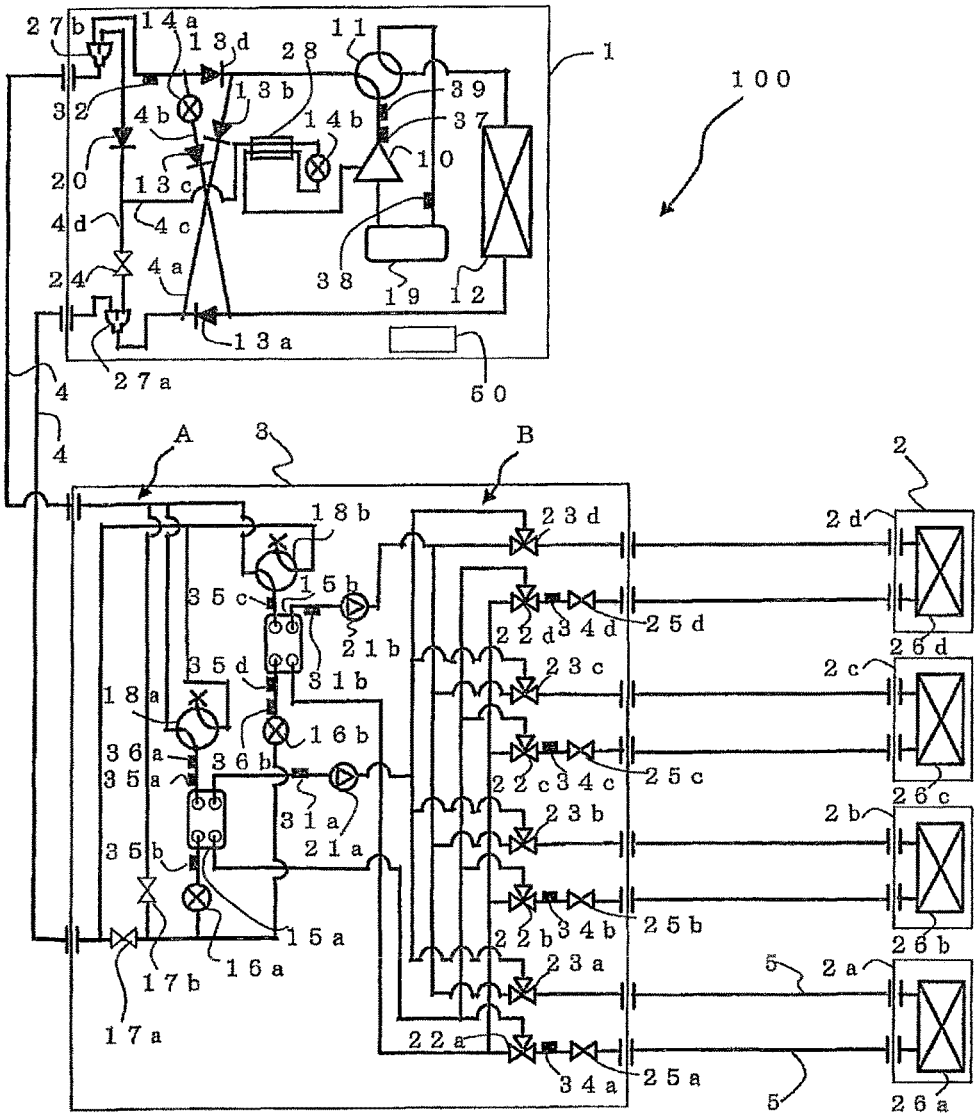
FIG. 14 is a diagram illustrating a circuit configuration of an air-conditioning apparatus according to Embodiment 2 of the present invention.

FIG. 14 is a schematic diagram illustrating an exemplary circuit configuration of an air-conditioning apparatus 100 according to Embodiment 2. Embodiment 2 of the present invention will be described with reference to the drawings. The following explanations are given with emphasis on the difference from Embodiment 1 in Embodiment 2. The air-conditioning apparatus 100 according to Embodiment 2 includes a refrigerant-refrigerant heat exchanger (heat exchanger related to refrigerant) 28 attached to the injection pipe 4*c* connecting to the opening of the compression chamber of the compressor 10. The refrigerant-refrigerant heat exchanger 28 exchanges heat between the heat source side refrigerant to be pressure-reduced by the expansion device 14*b* and the heat source side refrigerant which has been pressure-reduced.

An operation will now be described for each operation mode performed by the air-conditioning apparatus 100. The flow of the heat medium in the air-conditioning apparatus 100 is the same as that in Embodiment 1. Accordingly, the difference in the flow of the heat source side refrigerant in the air-conditioning apparatus 100 between Embodiment 2 and Embodiment 1 will be described below.

[Cooling Only Operation Mode]

Figure 15:
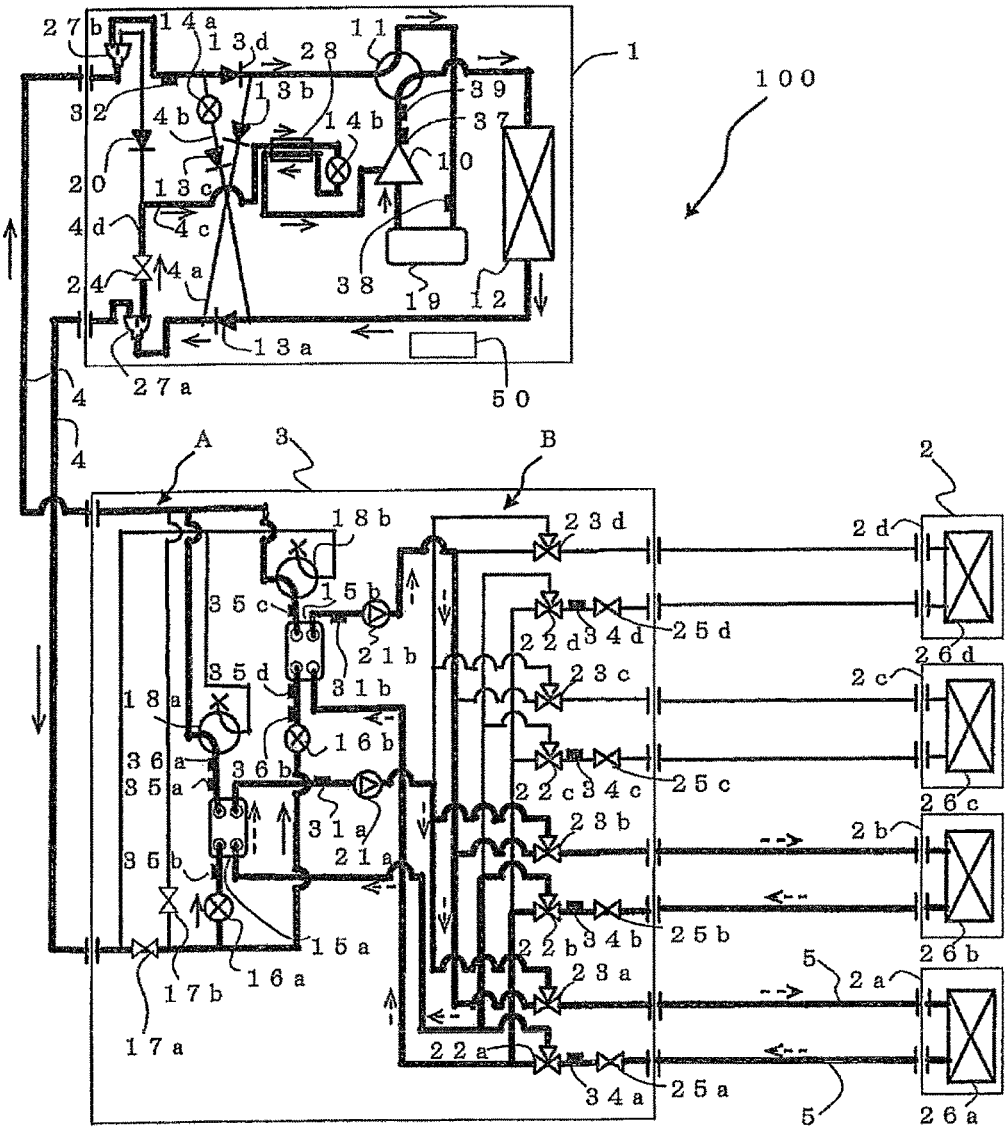
FIG. 15 is a diagram illustrating a circuit configuration of the air-conditioning apparatus according to Embodiment 2 of the present invention in the cooling only operation.

FIG. 15 is a refrigerant circuit diagram illustrating the flows of the refrigerants in the cooling only operation mode of the air-conditioning apparatus 100 according to Embodiment 2. Referring to FIG. 15, a low-temperature low-pressure heat source side refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant condenses and liquefies while transferring heat to the outdoor air in the heat source side heat exchanger 12, such that it turns into a high-pressure liquid refrigerant. The high-pressure liquid refrigerant, which has flowed out of the heat source side heat exchanger 12, passes through the check valve 13*a*, flows through the branching portion 27*a* out of the outdoor unit 1, passes through the refrigerant pipe 4, and flows into the heat medium relay unit 3. The high-pressure liquid refrigerant, which has flowed into the heat medium relay unit 3, passes through the opening and closing device 17*a* and is then divided into flows to the expansion device 16*a* and the expansion device 16*b*, in each of which the refrigerant is expanded into a low-temperature low-pressure two-phase refrigerant.

These flows of two-phase refrigerant enter the heat exchanger related to heat medium 15*a* and the heat exchanger related to heat medium 15*b*, functioning as evaporators, in each of which the refrigerant absorbs heat from the heat medium circulating in the heat medium circuits B to cool the heat medium, and thus turns into a low-temperature low-pressure gas refrigerant. The gas refrigerant, which has flowed from the heat exchanger related to heat medium 15*a* and the heat exchanger related to heat medium 15*b*, flows through the second refrigerant flow switching device 18*a* and the second refrigerant flow switching device 18*b* and out of the heat medium relay unit 3, passes through the refrigerant pipe 4, and again flows into the outdoor unit 1. The heat source side refrigerant, which has flowed into the outdoor unit 1, passes through the branching portion 27*b*, the check valve 13*d*, the first refrigerant flow switching device 11, and the accumulator 19, and is then again sucked into the compressor 10.

Figure 16:
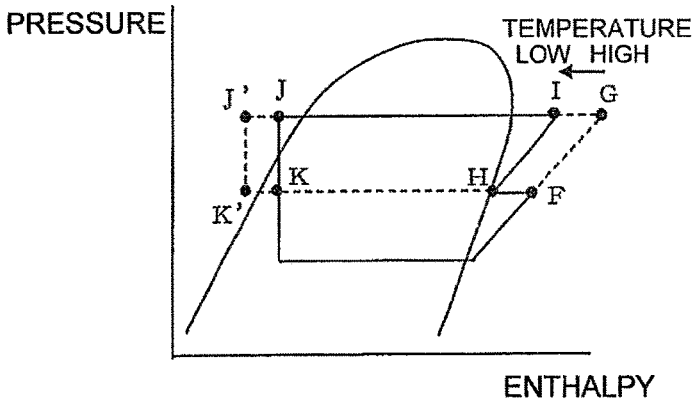
FIG. 16 is a p-h diagram (pressure-enthalpy diagram) in the cooling only operation of the air-conditioning apparatus according to Embodiment 2 of the present invention.

FIG. 16 is a graph illustrating a p-h diagram (pressure-enthalpy diagram) in the cooling only operation mode according to Embodiment 2. For example, an operation, performed by the air-conditioning apparatus 100, for reducing the discharge temperature using an injection circuit will be described with reference to FIGS. 15 and 16. In the compression chamber of the compressor 10, the sucked low-temperature low-pressure gas refrigerant is gradually reduced in internal volume during a 0 degree to 360 degree rotation by the motor (not illustrated), so that the heat source side refrigerant inside the compression chamber is compressed such that its pressure and temperature rise. When the angle of rotation by the motor reaches a predetermined angle, the opening is opened (such a state corresponds to point F in FIG. 16) and the inside of the compression chamber communicates with the injection pipe 4*c* outside the compressor 10.

The heat source side refrigerant compressed by the compressor 10 is condensed and liquefied into a high-pressure liquid refrigerant (at point J in FIG. 16) in the heat source side heat exchanger 12 and passes through the check valve 13*a* and then reaches the branching portion 27*a*. The injection opening and closing device 24 is opened to allow the flow of the high-pressure liquid refrigerant to be divided into parts by the branching portion 27*a* such that one part flows through the injection opening and closing device 24 and the branch pipe 4*d* into the injection pipe 4*c*. The one part of the refrigerant flows through the refrigerant-refrigerant heat exchanger 28 and is then pressure-reduced by the expansion device 14*b*, such that it turns into a low-temperature intermediate-pressure two-phase refrigerant. The refrigerant-refrigerant heat exchanger 28 exchanges heat between the heat source side refrigerant to be pressure-reduced by the expansion device 14*b* and the heat source side refrigerant which has been pressure-reduced. In the refrigerant-refrigerant heat exchanger 28, the heat source side refrigerant which is going to flow into the expansion device 14*b* is cooled by the heat source side refrigerant which has been pressure-reduced and therefore has a lower pressure and a lower temperature (the temperature corresponds to point J' in FIG. 16). The cooled refrigerant is pressure-reduced by the expansion device 14*b* (point K in FIG. 16) and is then heated by the heat source side refrigerant to be pressure-reduced in the refrigerant-refrigerant heat exchanger 28 (point K in FIG. 16) and flows into the compression chamber. When being supplied with the heat source side refrigerant in a two-phase state, the expansion device 14*b* may fail to perform a stable control. With the above-described configuration, if subcooling (degree of subcooling) is small at an outlet of the heat source side heat exchanger 12 because, for example, the amount of sealed-in refrigerant is small, a liquid refrigerant can be reliably supplied to the expansion device 14*b*, thus resulting in a stable control.

[Heating Only Operation Mode]

Figure 17:
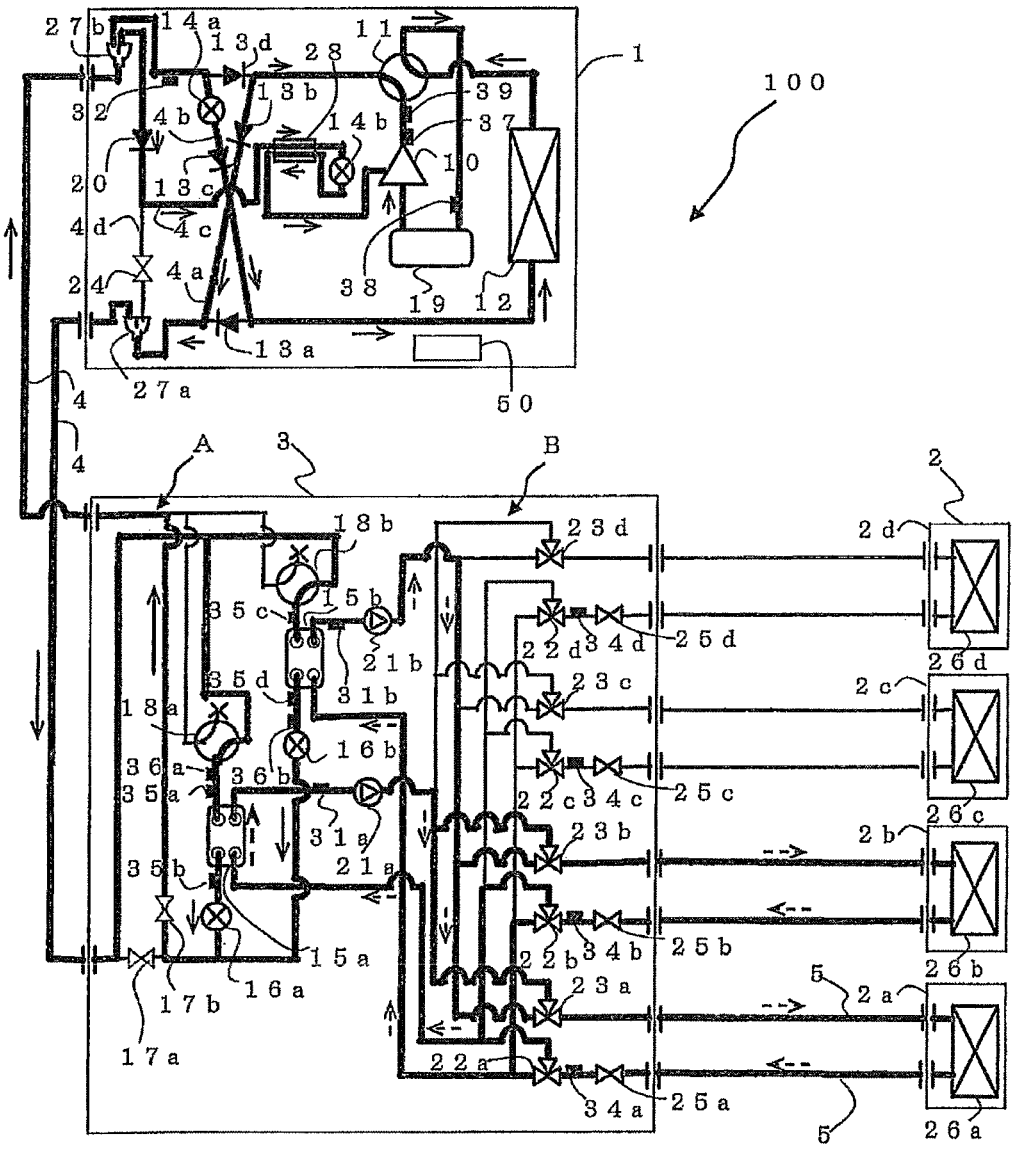
FIG. 17 is a diagram illustrating a circuit configuration of the air-conditioning apparatus according to Embodiment 2 of the present invention in the heating only operation.

FIG. 17 is a refrigerant circuit diagram illustrating the flows of the refrigerants in the heating only operation mode of the air-conditioning apparatus 100. A low-temperature low-pressure heat source side refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b* and the branching portion 27*a*, and flows out of the outdoor unit 1. The high-temperature high-pressure gas refrigerant, which has flowed out of the outdoor unit 1, passes through the refrigerant pipe 4 and flows into the heat medium relay unit 3. The high-temperature high-pressure gas refrigerant, which has flowed into the heat medium relay unit 3, is divided into flows such that the flows pass through the second refrigerant flow switching device 18*a* and the second refrigerant flow switching device 18*b* and then enter the heat exchanger related to heat medium 15*a* and the heat exchanger related to heat medium 15*b*.

The high-temperature high-pressure gas refrigerant, which has flowed into the heat exchanger related to heat medium 15*a* and the heat exchanger related to heat medium 15*b*, condenses and liquefies while transferring heat to the heat medium circulating in the heat medium circuits B, such that it turns into a high-pressure liquid refrigerant. The liquid refrigerant flowing from the heat exchanger related to heat medium 15*a* and that flowing from the heat exchanger related to heat medium 15*b* are expanded into an intermediate-temperature, intermediate-pressure two-phase refrigerant or liquid refrigerant by the expansion device 16*a* and the expansion device 16*b*, respectively. This two-phase refrigerant or liquid refrigerant passes through the opening and closing device 17*b*, flows out of the heat medium relay unit 3, passes through the refrigerant pipe 4, and again flows into the outdoor unit 1. The heat source side refrigerant, which has flowed into the outdoor unit 1, flows through the branching portion 27*b* into the second connecting pipe 4*b*, passes through the expansion device 14*a* while the flow of the refrigerant is being regulated by the expansion device 14*a* such that it turns into a low-temperature low-pressure two-phase refrigerant, passes through the check valve 13*c*, and flows into the heat source side heat exchanger 12, functioning as an evaporator.

The heat source side refrigerant, which has flowed into the heat source side heat exchanger 12, absorbs heat from the outdoor air in the heat source side heat exchanger 12, such that it turns into a low-temperature low-pressure gas refrigerant. The low-temperature low-pressure gas refrigerant, which has flowed out of the heat source side heat exchanger 12, passes through the first refrigerant flow switching device 11 and the accumulator 19 and is again sucked into the compressor 10.

Figure 18:
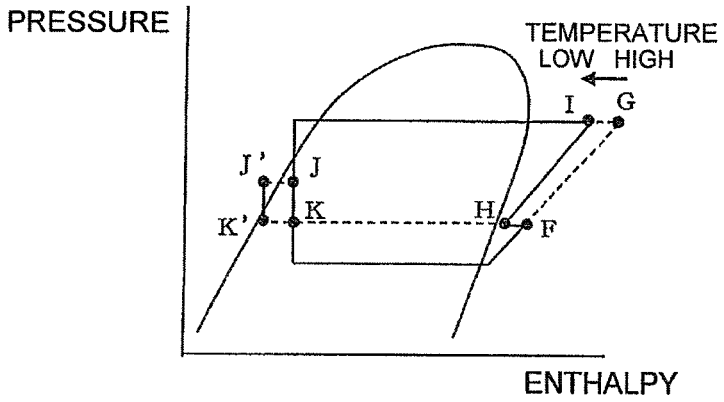
FIG. 18 is a p-h diagram (pressure-enthalpy diagram) in the cooling only operation of the air-conditioning apparatus according to Embodiment 2 of the present invention.

FIG. 18 is a graph illustrating a p-h diagram (pressure-enthalpy diagram) in the heating only operation mode according to Embodiment 2. For example, the operation, performed by the air-conditioning apparatus 100, for reducing the discharge temperature using the injection circuit will be described with reference to FIGS. 17 and 18. In the compression chamber of the compressor 10, the sucked low-temperature low-pressure gas refrigerant is gradually reduced in internal volume during a 0 degree to 360 degree rotation by the motor (not illustrated), so that the heat source side refrigerant inside the compression chamber is compressed such that its pressure and temperature rise. When the angle of rotation by the motor reaches a predetermined angle, the opening is opened (such a state corresponds to point F in FIG. 18) and the inside of the compression chamber communicates with the injection pipe 4*c* outside the compressor 10.

The heat source side refrigerant returning from the heat medium relay unit 3 through the refrigerant pipe 4 to the outdoor unit 1 flows through the branching portion 27*b* into the expansion device 14*a*. The pressure of the flow of the heat source side refrigerant in the air-conditioning apparatus 100 is controlled in an intermediate-pressure state (at point J in FIG. 18) by working of the expansion device 14*a*. The two-phase refrigerant or liquid refrigerant, which has been made in the intermediate-pressure state by the expansion device 14*a*, is divided into parts by the branching portion 27*b* such that one part flows into the branch pipe 4*d* and then flows through the backflow prevention device 20 into the injection pipe 4*c*. Then, the one part of the refrigerant flows through the refrigerant-refrigerant heat exchanger 28 into the expansion device 14*b* in which the refrigerant is pressure-reduced, so that it turns into a low-temperature intermediate-pressure two-phase refrigerant whose pressure is slightly lower. The refrigerant-refrigerant heat exchanger 28 exchanges heat between the heat source side refrigerant to be pressure-reduced by the expansion device 14*b* and the heat source side refrigerant which has been pressure-reduced. In the refrigerant-refrigerant heat exchanger 28, the heat source side refrigerant which is going to flow into the expansion device 14*b* is cooled by the heat source side refrigerant which has been pressure-reduced and therefore has a lower pressure and a lower temperature (the temperature corresponds to point J' in FIG. 18). The cooled refrigerant is pressure-reduced by the expansion device 14*b* (point K' in FIG. 18) and is then heated by the heat source side refrigerant to be pressure-reduced in the refrigerant-refrigerant heat exchanger 28 (point K in FIG. 18) and flows into the compression chamber. When being supplied with the heat source side refrigerant in a two-phase state, the expansion device 14*b* may fail to perform a stable control. With the above-described arrangement, the heat source side refrigerant in an intermediate-pressure two-phase state can be allowed to turn into an intermediate-pressure liquid refrigerant and then flow into the expansion device 14*b*, thus resulting in a stable control.

[Cooling Main Operation Mode]

Figure 19:
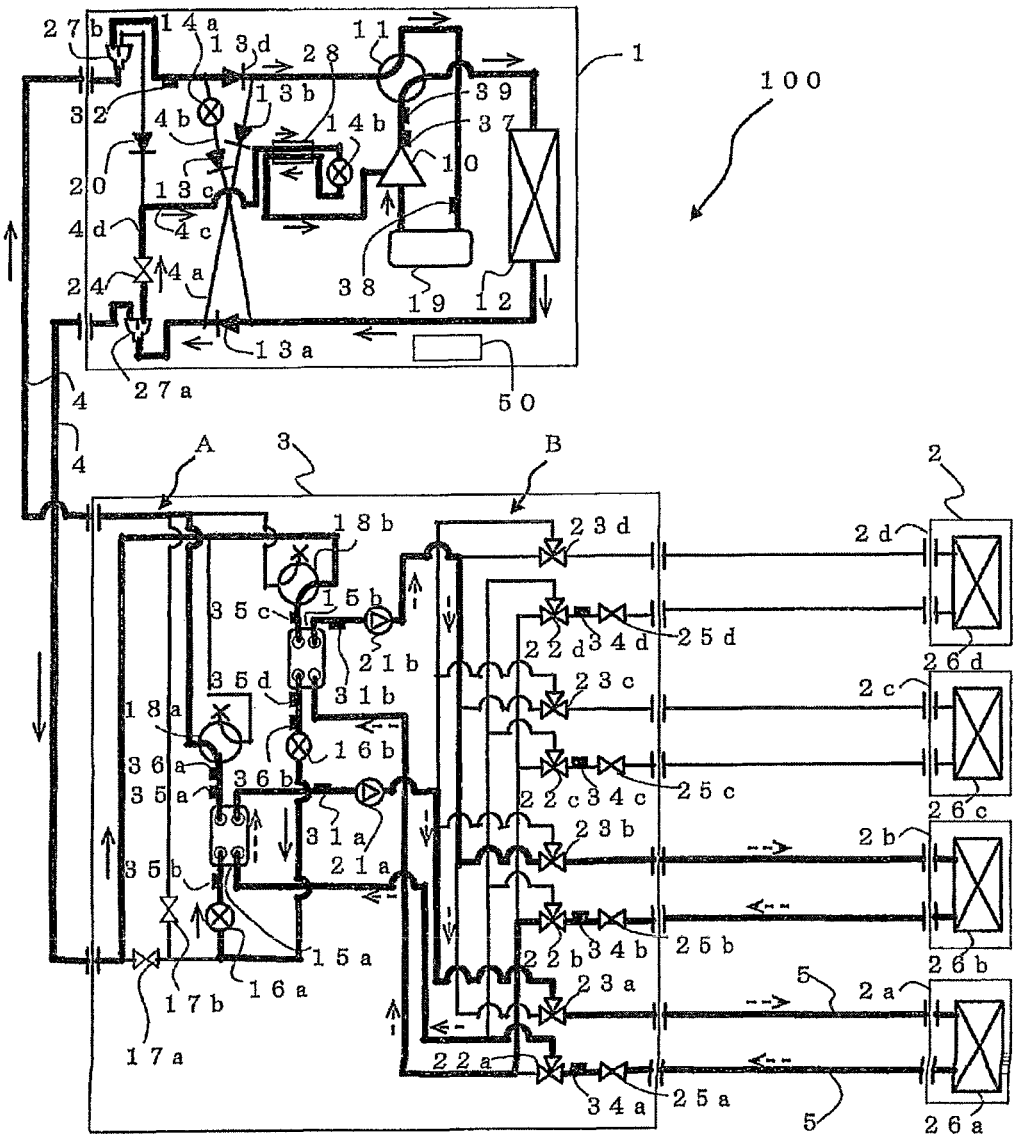
FIG. 19 is a diagram illustrating a circuit configuration of the air-conditioning apparatus according to Embodiment 2 of the present invention in the cooling main operation.

FIG. 19 is a refrigerant circuit diagram illustrating the flows of the refrigerants in the cooling main operation mode of the air-conditioning apparatus 100. A low-temperature low-pressure heat source side refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant condenses into a two-phase refrigerant in the heat source side heat exchanger 12 while transferring heat to the outdoor air. The two-phase refrigerant, which has flowed out of the heat source side heat exchanger 12, passes through the check valve 13*a*, flows through the branching portion 27*a* and out of the outdoor unit 1, passes through the refrigerant pipe 4, and flows into the heat medium relay unit 3. The two-phase refrigerant, which has flowed into the heat medium relay unit 3, passes through the second refrigerant flow switching device 18*b* and flows into the heat exchanger related to heat medium 15*b*, functioning as a condenser.

The two-phase refrigerant, which has flowed into the heat exchanger related to heat medium 15*b*, condenses and liquefies while transferring heat to the heat medium circulating in the heat medium circuit B, such that it turns into a liquid refrigerant. The liquid refrigerant, which has flowed out of the heat exchanger related to heat medium 15*b*, is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant, which has flowed into the heat exchanger related to heat medium 15*a*, absorbs heat from the heat medium circulating in the heat medium circuit B to cool the heat medium, and thus turns into a low-pressure gas refrigerant. The gas refrigerant flows out of the heat exchanger related to heat medium 15*a*, flows through the second refrigerant flow switching device 18*a* and out of the heat medium relay unit 3, passes through the refrigerant pipe 4, and again flows into the outdoor unit 1. The heat source side refrigerant, which has flowed into the outdoor unit 1, passes through the branching portion 27*b*, the check valve 13*d*, the first refrigerant flow switching device 11, and the accumulator 19, and is then again sucked into the compressor 10.

Figure 20:
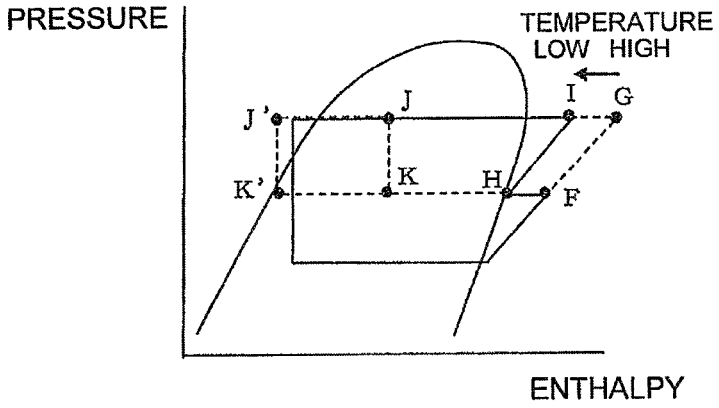
FIG. 20 is a p-h diagram (pressure-enthalpy diagram) in the cooling main operation of the air-conditioning apparatus according to Embodiment 2 of the present invention.

FIG. 20 is a graph illustrating a p-h diagram (pressure-enthalpy diagram) in the cooling main operation mode according to Embodiment 2. For example, the operation, performed by the air-conditioning apparatus 100, for reducing the discharge temperature using the injection circuit will be described with reference to FIGS. 19 and 20. In the compression chamber of the compressor 10, the sucked low-temperature low-pressure gas refrigerant is gradually reduced in internal volume during a 0 degree to 360 degree rotation by the motor (not illustrated), so that the heat source side refrigerant inside the compression chamber is compressed such that its pressure and temperature rise. When the angle of rotation by the motor reaches a predetermined angle, the opening is opened (such a state corresponds to point F in FIG. 20) and the inside of the compression chamber communicates with the injection pipe 4*c* outside the compressor 10.

The heat source side refrigerant compressed by the compressor 10 is condensed into a high-pressure two-phase refrigerant (at point J in FIG. 20) in the heat source side heat exchanger 12 and passes through the check valve 13*a* and then reaches the branching portion 27*a*. The injection opening and closing device 24 is opened to allow the flow of the high-pressure two-phase refrigerant to be divided into parts by the branching portion 27*a* such that one part flows through the injection opening and closing device 24 and the branch pipe 4*d* into the injection pipe 4*c*. The one part of the refrigerant flows through the refrigerant-refrigerant heat exchanger 28 and is then pressure-reduced by the expansion device 14*b*, such that it turns into a low-temperature intermediate-pressure two-phase refrigerant. The refrigerant-refrigerant heat exchanger 28 exchanges heat between the heat source side refrigerant to be pressure-reduced by the expansion device 14*b* and the heat source side refrigerant which has been pressure-reduced. In the refrigerant-refrigerant heat exchanger 28, the heat source side refrigerant which is going to flow into the expansion device 14*b* is cooled by the heat source side refrigerant which has been pressure-reduced and therefore has a lower pressure and a lower temperature (the temperature corresponds to point S in FIG. 20). The cooled refrigerant is pressure-reduced by the expansion device 14*b* (point K' in FIG. 20) and is then heated by the heat source side refrigerant to be pressure-reduced in the refrigerant-refrigerant heat exchanger 28 (point K in FIG. 20) and flows into the compression chamber. When being supplied with the heat source side refrigerant in a two-phase state, the expansion device 14*b* may fail to perform a stable control. With the above-described arrangement, the heat source side refrigerant in a high-pressure two-phase state can be allowed to turn into a high-pressure liquid refrigerant and then flow into the expansion device 14*b*, thus resulting in a stable control.

[Heating Main Operation Mode]

Figure 21:
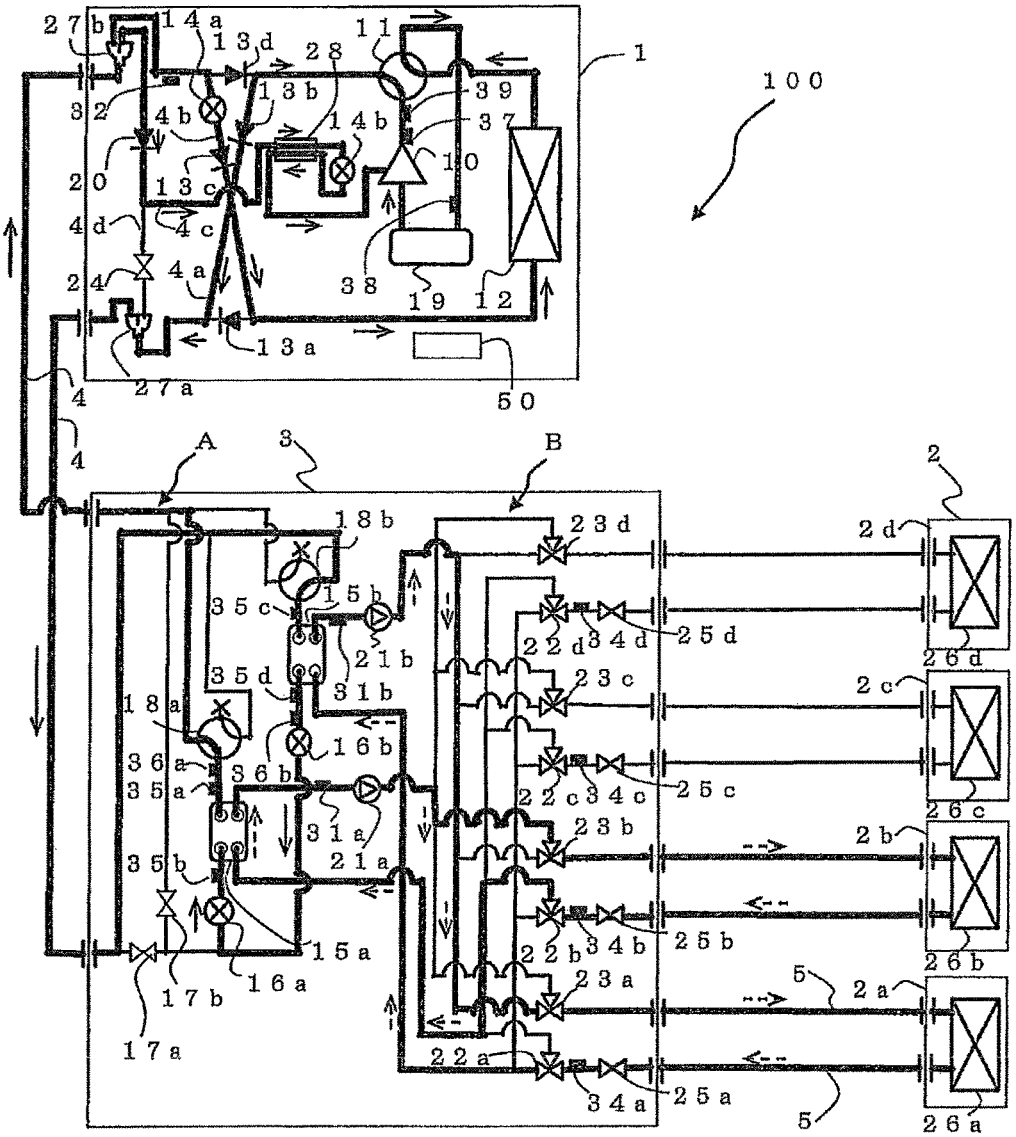
FIG. 21 is a diagram illustrating a circuit configuration of the air-conditioning apparatus according to Embodiment 2 of the present invention in the heating main operation.

FIG. 21 is a refrigerant circuit diagram illustrating the flows of the refrigerants in the heating main operation mode of the air-conditioning apparatus 100. A low-temperature low-pressure heat source side refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting pipe 4*a*, passes through the check valve 13*b*, and flows through the branching portion 27*a* and out of the outdoor unit 1. The high-temperature high-pressure gas refrigerant, which has flowed out of the outdoor unit 1, passes through the refrigerant pipe 4 and flows into the heat medium relay unit 3. The high-temperature high-pressure gas refrigerant, which has flowed into the heat medium relay unit 3, passes through the second refrigerant flow switching device 18*b* and flows into the heat exchanger related to heat medium 15*b*, functioning as a condenser.

The gas refrigerant, which has flowed into the heat exchanger related to heat medium 15*b*, condenses and liquefies while transferring heat to the heat medium circulating in the heat medium circuit B, such that it turns into a liquid refrigerant. The liquid refrigerant, which has flowed out of the heat exchanger related to heat medium 15*b*, is expanded into an intermediate-pressure two-phase refrigerant by the expansion device 16*b*. This intermediate-pressure two-phase refrigerant flows through the expansion device 16*a* into the heat exchanger related to heat medium 15*a*, functioning as an evaporator. The intermediate-pressure two-phase refrigerant, which has flowed into the heat exchanger related to heat medium 15*a*, absorbs heat from the heat medium circulating in the heat medium circuit B to evaporate, thus cooling the heat medium. This intermediate-pressure two-phase refrigerant flows out of the heat exchanger related to heat medium 15*a*, passes through the second refrigerant flow switching device 18*a*, flows out of the heat medium relay unit 3, passes through the refrigerant pipe 4, and again flows into the outdoor unit 1.

The heat source side refrigerant, which has flowed into the outdoor unit 1, flows through the branching portion 27*b* into the second connecting pipe 4*b*, passes through the expansion device 14*a* while the flow of the refrigerant is being regulated by the expansion device 14*a* such that it turns into a low-temperature low-pressure two-phase refrigerant, passes through the check valve 13*c*, and flows into the heat source side heat exchanger 12, functioning as an evaporator. The heat source side refrigerant, which has flowed into the heat source side heat exchanger 12, absorbs heat from the outdoor air in the heat source side heat exchanger 12, such that it turns into a low-temperature low-pressure gas refrigerant. The low-temperature low-pressure gas refrigerant, which has flowed out of the heat source side heat exchanger 12, passes through the first refrigerant flow switching device 11 and the accumulator 19 and is again sucked into the compressor 10.

Figure 22:
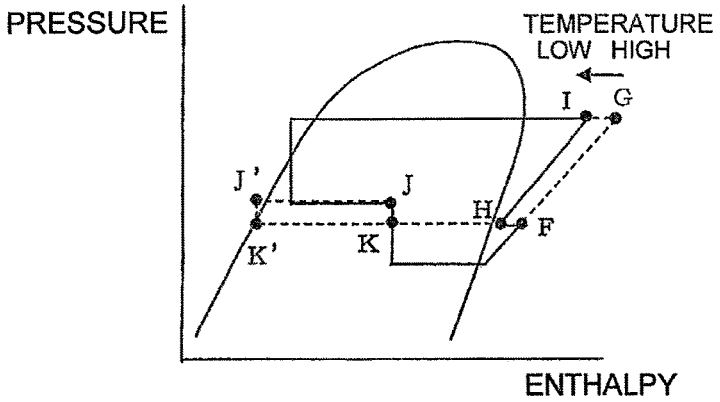
FIG. 22 is a p-h diagram (pressure-enthalpy diagram) in the heating main operation of the air-conditioning apparatus according to Embodiment 2 of the present invention.

FIG. 22 is a graph illustrating a p-h diagram (pressure-enthalpy diagram) in the heating main operation mode according to Embodiment 2. For example, the operation, performed by the air-conditioning apparatus 100, for reducing the discharge temperature using the injection circuit will be described with reference to FIGS. 21 and 22. In the compression chamber of the compressor 10, the sucked low-temperature low-pressure gas refrigerant is gradually reduced in internal volume during a 0 degree to 360 degree rotation by the motor (not illustrated), so that the heat source side refrigerant inside the compression chamber is compressed such that its pressure and temperature rise. When the angle of rotation by the motor reaches a predetermined angle, the opening is opened (such a state corresponds to point F in FIG. 22) and the inside of the compression chamber communicates with the injection pipe 4*c* outside the compressor 10.

The heat source side refrigerant returning from the heat medium relay unit 3 through the refrigerant pipe 4 to the outdoor unit 1 flows through the branching portion 27*b* into the expansion device 14*a*. The pressure of the flow of the heat source side refrigerant in the air-conditioning apparatus 100 is controlled in an intermediate-pressure state (at point J in FIG. 22) by working of the expansion device 14*a*. The two-phase refrigerant, which has been made in the intermediate-pressure state by the expansion device 14*a*, is divided into parts by the branching portion 27*b* such that one part flows into the branch pipe 4*d* and then flows through the backflow prevention device 20 into the injection pipe 4*c*. Then, the one part of the refrigerant flows through the refrigerant-refrigerant heat exchanger 28 into the expansion device 14*b* in which it is pressure-reduced, so that it turns into a low-temperature intermediate-pressure two-phase refrigerant whose pressure is lower. The refrigerant-refrigerant heat exchanger 28 exchanges heat between the heat source side refrigerant to be pressure-reduced by the expansion device 14*b* and the heat source side refrigerant which has been pressure-reduced. In the refrigerant-refrigerant heat exchanger 28, the heat source side refrigerant which is going to flow into the expansion device 14*b* is cooled by the heat source side refrigerant which has been pressure-reduced and therefore has a lower pressure and a lower temperature (the temperature corresponds to point J' in FIG. 22), so that the refrigerant liquefies. The refrigerant is pressure-reduced by the expansion device 14*b* (point K' in FIG. 22) and is then heated by the heat source side refrigerant to be pressure-reduced in the refrigerant-refrigerant heat exchanger 28 (point K in FIG. 22) and flows into the compression chamber. When being supplied with the heat source side refrigerant in a two-phase state, the expansion device 14*b* may fail to perform a stable control. With the above-described arrangement, the heat source side refrigerant in an intermediate-pressure two-phase state can be allowed to turn into an intermediate-pressure liquid refrigerant and then flow into the expansion device 14*b*, thus resulting in a stable control.

As described above, since the air-conditioning apparatus 100 according to Embodiment 2 includes the refrigerant-refrigerant heat exchanger 28 to allow the refrigerant flowing into the expansion device 14*b* to turn into a liquid refrigerant, for example, hunting can be prevented and a stable control can be achieved in addition to the advantages of Embodiment 1.

Embodiment 3

In Embodiments 1 and 2, the outdoor unit 1 accommodates the compressor 10, the first refrigerant flow switching device 11, the heat source side heat exchanger 12, the expansion device 14*a*, the expansion device 14*b*, the opening and closing device 17, and the backflow prevention device 20. In addition, each indoor unit 2 accommodates the use side heat exchanger 26 and the heat medium relay unit 3 accommodates the heat exchangers related to heat medium 15 and the expansion devices 16. The system in which the outdoor unit 1 and the heat medium relay unit 3 are connected by one pair of pipes to circulate the heat source side refrigerant between the outdoor unit 1 and the heat medium relay unit 3, each indoor unit 2 and the heat medium relay unit 3 are connected by one pair of pipes to circulate the heat medium between the indoor unit 2 and the heat medium relay unit 3, and each heat exchanger related to heat medium 15 exchanges heat between the heat source side refrigerant and the heat medium has been described as an example. The system is not limited to this example.

Figure 23:
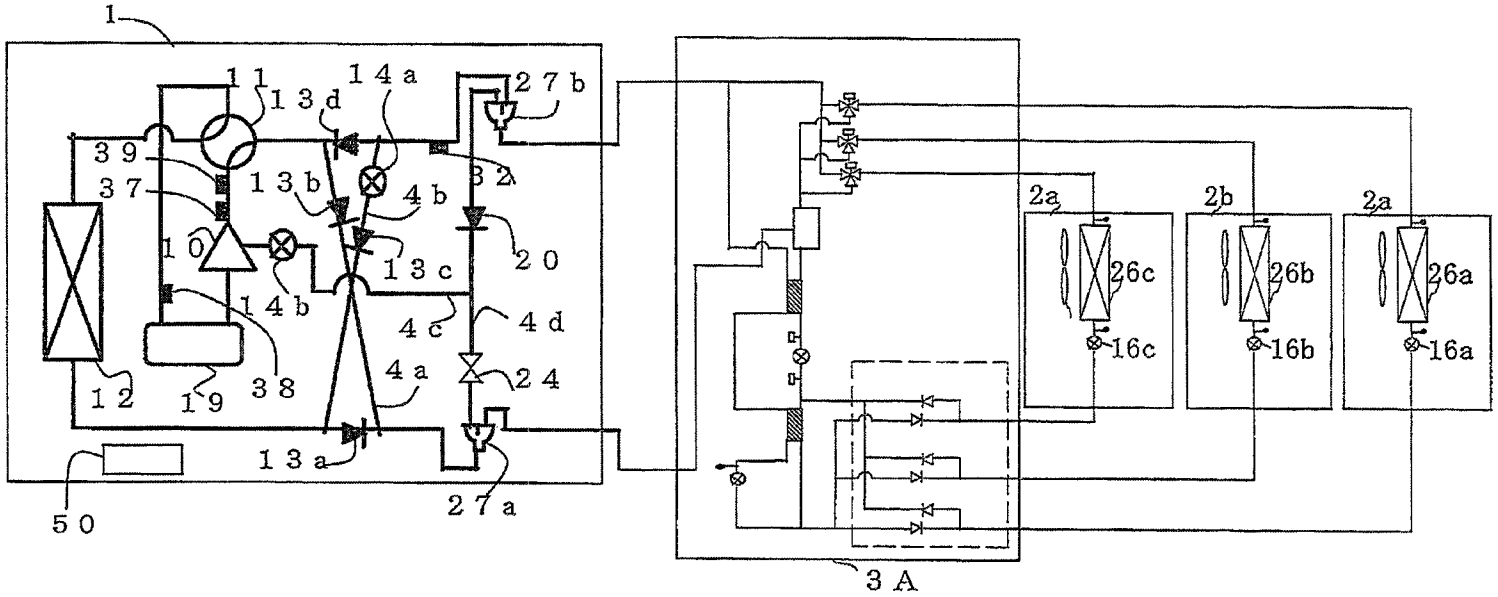
FIG. 23 is a diagram illustrating a configuration of an air-conditioning apparatus according to Embodiment 3 of the present invention.

FIG. 23 is a diagram illustrating a configuration of an air-conditioning apparatus according to Embodiment 3. The present invention can be applied to a direct expansion system having the following configuration. For example, the outdoor unit 1 accommodates the compressor 10, the first refrigerant flow switching device 11, the heat source side heat exchanger 12, the expansion device 14*a*, the expansion device 14*b*, the opening and closing device 17, and the backflow prevention device 20. Furthermore, each indoor unit 2 accommodates the expansion device 16 and the load side heat exchanger 26, which functions as an evaporator or a condenser to exchange heat between air in an air-conditioning target space and the refrigerant. The system further includes a relay unit 3A which serves as a relay unit separated from the outdoor unit 1 and the indoor units 2. The outdoor unit 1 and the relay unit 3A are connected by one pair of pipes, each indoor unit and the relay unit 3A are connected by one pair of pipes, and the refrigerant is circulated through the relay unit 3A between the outdoor unit 1 and each indoor unit 2, thus achieving the cooling only operation, the heating only operation, the cooling main operation, and the heating main operation. The same advantages can be achieved.

REFERENCE SIGNS LIST

1, outdoor unit (outdoor unit); 2, 2*a*, 2*b*, 2*c*, 2*d*, indoor unit; 3, heat medium relay unit (relay unit); 3A, relay unit; 4, refrigerant pipe; 4*a*, 4*b*, connecting pipe; 4*c*, injection pipe; 4*d*, branch pipe; 5, pipe (through which a heat medium, such as water or antifreeze, flows); 6, outdoor space; 7, indoor space; 8, space (different from an outdoor space and an indoor space, for example, a space above a ceiling); 9, structure (e.g., a building); 10, compressor; 11, first refrigerant flow switching device; 12, heat source side heat exchanger; 13*a*, 13*b*, 13*c*, 13*d*, check valve; 14*a*, 14*b*, expansion device; 15*a*, 15*b*, heat exchanger related to heat medium; 16*a*, 16*b*, expansion device; 17*a*, 17*b*, opening and closing device; 18*a*, 18*b*, second refrigerant flow switching device; 19, accumulator; 20, backflow prevention device (check valve); 21*a*, 21*b*, pump (heat medium sending device); 22*a*, 22*b*, 22*c*, 22*d*, heat medium flow switching device; 23*a*, 23*b*, 23*c*, 23*d*, heat medium flow switching device; 24, injection opening and closing device; 25*a*, 25*b*, 25*c*, 25*d*, heat medium flow control device; 26*a*, 26*b*, 26*c*, 26*d*, use side heat exchanger; 27*a*, 27*b*, branching portion; 28; refrigerant-refrigerant heat exchanger; 31, 31*a*, 31*b*, heat-exchanger-related-to-heat-medium outlet temperature detection device; 32, intermediate-pressure detection device; 34, 34*a*, 34*b*, 34*c*, 34*d*, use-side-heat-exchanger outlet temperature detection device; 35, 35*a*, 35*b*, 35*c*, 35*d*, heat-exchanger-related-to-heat-medium refrigerant temperature detection device; 36, 36*a*, 36*b*, heat-exchanger-related-to-heat-medium refrigerant pressure detection device; 37, refrigerant discharge temperature detection device; 38, refrigerant suction temperature detection device; 39, high-pressure detection device; 41, inlet pipe; 42, outlet pipe; 43, expansion portion; 44, valve body; 45, motor; 46, agitator; 50, controller; 100, air-conditioning apparatus; A, refrigerant circuit; and B, heat medium circuit.

The invention claimed is:

1. An air-conditioning apparatus, comprising an indoor unit, an outdoor unit, and a relay unit that is separated from the outdoor unit and the indoor unit, connected by pipes, further comprising:

a refrigerant circuit including a compressor that includes a compression chamber having an opening into which a refrigerant flowing through an injection pipe flows, a first heat exchanger and at least one second heat exchanger that are configured to evaporate or condense the refrigerant, at least one first expansion device that is disposed corresponding to the at least second heat exchanger and reduces a pressure of the refrigerant, a refrigerant flow switching device that switches between a passage allowing a high-pressure refrigerant to pass through the first heat exchanger such that the first heat exchanger is allowed to function as a condenser and a passage allowing a low-pressure refrigerant to pass through the first heat exchanger such that the first heat exchanger is allowed to function as an evaporator, a second expansion device configured to allow the refrigerant which has been decompressed after passing through the first expansion device and flows from the second heat exchanger to the first heat exchanger to be further decompressed so that the refrigerant has an intermediate pressure which is lower than the high pressure and is higher than the low pressure, a first refrigerant branching portion that is disposed in a pipe between the first expansion device and the second expansion device, one of branched portions of the first refrigerant branching portion being connected to the injection pipe, the first refrigerant branching portion branching the refrigerant off from a refrigerant passage through which the refrigerant flows from the first heat exchanger to the first expansion device, a second refrigerant branching portion that is disposed in a pipe between the first expansion device and the second expansion device, one of branched portions of the second refrigerant branching portion being connected to the injection pipe, the second refrigerant branching portion branching the refrigerant off from a refrigerant passage through which the refrigerant flows from the first expansion device to the first heat exchanger, and a third expansion device disposed in the injection pipe and configured to regulate an amount of the refrigerant flowing into the compressor, the compressor, the first heat exchanger, the second heat exchanger, the first expansion device, the refrigerant flow switching device, the second expansion device, the first refrigerant branching portion, the second refrigerant branching portion, and the third expansion device, being connected by pipes to constitute the refrigerant circuit; and a controller that controls the amount of the refrigerant flowing through the injection pipe into the compression chamber, wherein while the first heat exchanger functions as a condenser, a part of the high-pressure refrigerant that is branched at the first refrigerant branching portion and flows from the first heat exchanger to the second heat exchanger is enabled to flow through the injection pipe, and while the first heat exchanger functions as an evaporator, a part of the refrigerant that is branched at the second refrigerant branching portion and has the intermediate pressure by adjusting opening degree of the first expansion device and the second expansion device is enabled to flow through the injection pipe, and the outdoor unit accommodates the compressor, the refrigerant flow switching device, the first heat exchanger, the second expansion device, and the third expansion device.

2. The air-conditioning apparatus of claim 1, wherein while the first heat exchanger functions as a condenser, the refrigerant flows between the first heat exchanger and the second heat exchanger without passing through the second expansion device such that the refrigerant on the high-pressure side is supplied to the opening, and while the first heat exchanger functions as an evaporator, the refrigerant flows from the second heat exchanger through the second expansion device to the first heat exchanger such that the refrigerant on the intermediate-pressure side provided by the second expansion device is supplied to the opening.

3. The air-conditioning apparatus of claim 1, wherein the refrigerant is R32, a refrigerant mixture of R32 and HFO1234yf in which a mass percent of R32 is greater than or equal to 62%, or a refrigerant mixture of R32 and HFO1234ze in which the mass percent of R32 is greater than or equal to 43%.

4. The air-conditioning apparatus of claim 1, further comprising:

an opening and closing device that is disposed in a branch pipe and permits the refrigerant to pass therethrough only in a direction from the first refrigerant branching portion to the injection pipe; and a backflow prevention device disposed in a passage between a connection port and the second refrigerant branching portion in the branch pipe.

5. The air-conditioning apparatus of claim 4, wherein the first refrigerant branching portion and the second refrigerant branching portion are arranged such that the flow of the refrigerant is divided into parts while the flow of the refrigerant is provided in a direction opposite to the direction of gravity.

6. The air-conditioning apparatus of claim 4, wherein the third expansion device includes an injection refrigerant expansion portion that changes an opening area in a passage on the basis of an instruction from the controller, and an injection refrigerant agitator that agitates the refrigerant in a two-phase state at a position closer to a refrigerant inlet than the injection refrigerant expansion portion.

7. The air-conditioning apparatus of claim 6, wherein a distance between the injection refrigerant expansion portion and the injection refrigerant agitator is less than or equal to six times an inside diameter of a pipe at the refrigerant inlet of the third expansion device.

8. The air-conditioning apparatus of claim 6, wherein the injection refrigerant agitator comprises a porous metal having a porosity of 80% or higher.

9. The air-conditioning apparatus of claim 4, further comprising:

a refrigerant-refrigerant heat exchanger that is disposed in the injection pipe and that exchanges heat between the refrigerant flowing to the third expansion device and the refrigerant flowing from the third expansion device.

10. The air-conditioning apparatus of claim 1, wherein the second expansion device includes an intermediate-pressure refrigerant expansion portion that changes an opening area in a passage on the basis of an instruction from the controller, and an intermediate-pressure refrigerant agitator that agitates the refrigerant in a two-phase state at a position closer to a refrigerant inlet than the intermediate-pressure refrigerant expansion portion.

11. The air-conditioning apparatus of claim 10, wherein a distance between the intermediate-pressure expansion portion and the intermediate-pressure refrigerant agitator is less than or equal to six times an inside diameter of a pipe at the refrigerant inlet of the second expansion device.

12. The air-conditioning apparatus of claim 10, wherein the intermediate-pressure refrigerant agitator comprises a porous metal having a porosity of 80% or higher.

13. The air-conditioning apparatus of claim 1, further comprising:

an intermediate-pressure detection device that is disposed at a position where a pressure, serving as the intermediate-pressure, is detectable and that detects a pressure or a temperature, wherein the controller controls driving of the second expansion device such that a pressure related to detection by the intermediate-pressure detection device, a saturation pressure based on a temperature related to detection by the intermediate-pressure detection device, or a saturation temperature based on the temperature or pressure related to detection by the intermediate-pressure detection device approaches a target value or lies within a target range.

14. The air-conditioning apparatus of claim 4, wherein the outdoor unit accommodating the compressor, the refrigerant flow switching device, and the first heat exchanger is connected by two refrigerant pipes to the relay unit which accommodates the first expansion device and the second heat exchanger, wherein the relay unit is connected to a plurality of indoor units for heating or cooling air in an air-conditioning target space by pipes for circulating a heat medium different from the refrigerant, wherein the apparatus has, as operation patterns, a cooling only operation mode in which a high-pressure liquid refrigerant flows through one of the two refrigerant pipes and a low-pressure gas refrigerant flows through the other refrigerant pipe and a heating only operation mode in which a high-pressure gas refrigerant flows through one of the two refrigerant pipes and an intermediate-pressure two-phase refrigerant or an intermediate-pressure liquid refrigerant flows through the other refrigerant pipe, wherein when an operation in the cooling only operation mode is performed, the controller causes the opening and closing device to open to allow the high-pressure liquid refrigerant to flow from the first refrigerant branching portion through the opening and closing device into the injection pipe, and wherein when an operation in the heating only operation mode is performed, the controller causes the opening and closing device to close to allow the intermediate-pressure two-phase refrigerant or the intermediate-pressure liquid refrigerant to flow from the second refrigerant branching portion into the injection pipe.

15. The air-conditioning apparatus of claim 14, wherein the apparatus further has, as operation patterns, a cooling main operation mode in which a high-pressure two-phase refrigerant flows through one of the two refrigerant pipes and a low-pressure gas refrigerant flows through the other refrigerant pipe and a heating main operation mode in which a high-pressure gas refrigerant flows through one of the two refrigerant pipes and an intermediate-pressure two-phase refrigerant flows through the other refrigerant pipe, wherein when an operation in the cooling main operation mode is performed, the controller causes the opening and closing device to open to allow the high-pressure two-phase refrigerant to flow from the first refrigerant branching portion through the opening and closing device into the injection pipe, and wherein when an operation in the heating main operation mode is performed, the controller causes the opening and closing device to close to allow the intermediate-pressure two-phase refrigerant to flow from the second refrigerant branching portion into the injection pipe.

16. The air-conditioning apparatus of claim 4, further comprising:

a discharge temperature detection device configured to detect a discharge temperature of the compressor, wherein while the first heat exchanger is allowed to function as a condenser, the controller controls the third expansion device such that a temperature detected by the discharge temperature detection device approaches a target temperature or does not exceed the target temperature or lies within a target range, and wherein while the first heat exchanger is allowed to function as an evaporator, the controller controls the third expansion device or the second and third expansion devices such that a temperature detected by the discharge temperature detection device approaches a target temperature or does not exceed the target temperature or lies within a target range.

17. The air-conditioning apparatus of claim 4, further comprising:

a discharge temperature detection device configured to detect a discharge temperature of the compressor and a high-pressure detection device configured to detect a high pressure of the compressor, wherein while the first heat exchanger is allowed to function as a condenser, the controller controls the third expansion device such that a degree of discharge superheat calculated from a temperature detected by the discharge temperature detection device and a pressure detected by the high-pressure detection device approaches a target degree of superheat or does not exceed the target degree of superheat or lies within a target range, and wherein while the first heat exchanger is allowed to function as an evaporator, the controller controls the third expansion device or the second and third expansion devices such that a degree of discharge superheat calculated from a temperature detected by the discharge temperature detection device and a pressure detected by the high-pressure detection device approaches a target degree of superheat or does not exceed the target degree of superheat or lies within a target range.

18. The air-conditioning apparatus of claim 4, wherein while a defrosting operation for melting frost deposited on the first heat exchanger is performed, the controller controls the third expansion device such that the refrigerant cooled by the first heat exchanger while passing therethrough is allowed to flow through the injection pipe into the compression chamber.

19. The air-conditioning apparatus of claim 1, wherein the indoor unit is disposed at a position where it can perform air-conditioning of an air-conditioning target space and accommodates the second heat exchanger exchanging heat with air in the air-conditioning target space and the first expansion device;

the outdoor unit is placed outdoors or in a machine room; and a pair of pipes that connect the indoor unit and the relay unit and connect the outdoor unit and the relay unit are provided such that the refrigerant is circulated through the relay unit between the outdoor unit and the indoor unit.

20. The air-conditioning apparatus of claim 1, wherein the indoor unit is placed at a position where it can perform air-conditioning of an air-conditioning target space and accommodates a use side heat exchanger exchanging heat with air in the air-conditioning target space;

the outdoor unit is placed outdoors or in a machine room;

the relay unit accommodates the second heat exchanger and the first expansion device; and the air-conditioning apparatus further comprises a pair of pipes that connect the outdoor unit and the relay unit to circulate the refrigerant therebetween, and a pair of pipes that connect the indoor unit and the relay unit to circulate a heat medium different from the refrigerant therebetween, wherein the second heat exchanger exchanges heat between the refrigerant and the heat medium.

* * * * *